US006513468B2

(12) United States Patent
Takahashi et al.

(10) Patent No.: US 6,513,468 B2
(45) Date of Patent: Feb. 4, 2003

(54) VALVE TIMING CONTROL SYSTEM FOR INTERNAL COMBUSTION ENGINE

(75) Inventors: Tatsuhiko Takahashi, Hyogo (JP); Morio Fujiwara, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/982,932

(22) Filed: Oct. 22, 2001

(65) Prior Publication Data

US 2002/0166527 A1 Nov. 14, 2002

(30) Foreign Application Priority Data

May 8, 2001 (JP) ..... 2001-137666

(51) Int. Cl.[7] ..... F01L 1/34

(52) U.S. Cl. ..... 123/90.15; 123/90.16; 123/90.17; 123/90.12; 123/90.27; 123/90.31; 74/567; 251/12

(58) Field of Search ..... 123/90.15, 90.17, 123/90.12, 90.27, 90.31; 251/12; 74/567

(56) References Cited

U.S. PATENT DOCUMENTS 5,957,095 A * 9/1999 Kako ..... 123/90.15
6,311,667 B1 * 11/2001 Satou et al. ..... 123/295
6,330,870 B1 * 12/2001 Inoue et al. ..... 123/90.12

FOREIGN PATENT DOCUMENTS

JP 9-324613 12/1997
JP 11-210424 8/1999

* cited by examiner

*Primary Examiner*—Thomas Denion
*Assistant Examiner*—Ching Chang
(74) *Attorney, Agent, or Firm*—Sughrue Mion, PLLC

(57) ABSTRACT

A valve timing control system for an internal combustion engine for preventing dispersion of a control amount and unexpected unlocking of a lock pin is provided. The valve timing control system is provided with actuators 15 and 16 connected to cam shafts 15C and 16C, hydraulic pressure supply units 19 and 20 for driving the actuators, and a controller 21A for controlling a hydraulic pressure for the actuators depending on operating states while changing a relative phase of the cam shafts relative to crank shafts. The actuator includes a locking mechanism for setting the relative phase to a lock-up position and unlocking mechanisms for unlocking the locking mechanism in response to a predetermined hydraulic pressure, and the controller restricts a control of valve timing within a predetermined range of said lock-up position in the locking mechanism.

6 Claims, 16 Drawing Sheets

VALVE TIMING CONTROL SYSTEM FOR INTERNAL COMBUSTION ENGINE

This application is based on Application No. 2001-137666, filed in Japan on May 8, 2001, the contents of which are hereby incorporated by reference.

BACKGROUND OF THE INVENTION

1. Field of the Invention

The present invention relates in general terms to a valve timing control system for an internal combustion engine for controlling operation timings of intake valves and exhaust valves of the engine in dependence on engine operating states.

2. Description of Related Art

In recent years, the statutory regulations imposed in connection with emission of harmful materials or substances contained in the exhaust gas discharged to the atmosphere from the internal combustion engine mounted on a motor vehicle or automobile become more and more severe from the standpoint of environmental protection. Under the circumstances, there exists a great demand for reducing the emission of harmful materials or substances contained in the exhaust gas of the internal combustion engine.

In general, there have heretofore been known two sorts of methods of reducing the harmful exhaust gas components. One method is directed to reduction of the harmful gas directly discharged from the internal combustion engine (hereinafter also referred to simply as the engine) while the other method is directed to the reduction of the harmful components through posttreatment of the engine exhaust gas with the aid of a catalytic converter (hereinafter also referred to simply as the catalyst) installed within the exhaust pipe of the engine at an intermediate portion.

As is well known in the art, in the catalyst such as mentioned above, reaction of rendering the harmful gas components to be harmless is difficult or unable to take place unless the temperature of the catalyst has reached a predetermined value. Consequently, it is an important requirement to increase or rise speedily the temperature of the catalyst even when the internal combustion engine is, for example, in the course of starting operation in the cold state (i.e., in the state of low temperature).

In this conjunction, it is also known that in most of the internal combustion engines known heretofore, cam shafts which plays an essential role in determining the timings for opening and closing the intake or exhaust valves are so arranged as to be rotationally driven by a crank shaft through the medium of timing belts (or timing chains).

Accordingly, the timings for opening and closing the intake or exhaust valves (which timing may also be referred to as the cam angles) are so controlled as to remain constant relative to the crank angle notwithstanding of the fact that the valve timings as required may change in dependence on the operating states of the engine.

However, in recent years, a valve timing control system designed to be capable of changing or modifying the valve timings has been adopted for practical applications with a view to enhancing the fuel-cost performance of the engine while ensuring improvement of the exhaust gas quality.

The valve timing control system of this type is disclosed in, for example, in Japanese Patent Application Laid-Open Publication No. 324613/1997 (JP-A-9-324613).

The valve timing control system disclosed in the above-mentioned publication includes a variable valve timing mechanism (also referred to as the VVT mechanism in short) which is comprised of vanes each disposed rotatably within a housing for changing the phase (or angular position) of the cam shafts which is adapted to drive the intake valves and the exhaust valves. Incidentally, concerning arrangement of the vanes, description will be made later on.

At this juncture, however, it should be mentioned that in the engine starting operation, the vane of the variable valve timing mechanism is held substantially at a mid position (start corresponding position) for controlling or regulating the relative angular displacement of the cam angle relative to the crank angle and releasing the regulation or control after lapse of a predetermined time.

For having better understanding of the concept underlying the present invention, description will first be made in some detail of a hitherto known or conventional valve timing control system of an internal combustion engine. FIG. 12 is a functional block diagram showing generally and schematically a configuration of a conventional valve timing control system of an internal combustion engine together with several peripheral parts of the engine.

Referring to FIG. 12, provided in association with an intake pipe 4 for feeding the air into a combustion chamber(s) defined within the cylinder(s) of the engine 1 are an air cleaner 2 for purifying the intake air, an air flow sensor 3 for measuring the quantity or flow rate of the intake air. Further, installed in the intake pipe 4 are a throttle valve 5 for adjusting or regulating the intake air quantity (i.e., the amount or flow rate of the intake air) to thereby control the output of the engine 1, an idle speed control valve (also referred to simply as the ISCV in short) 6 for adjusting or regulating the intake air flow which bypasses the throttle valve 5 to thereby effectuate the engine rotation speed (rpm) control in the idling operation mode, and a fuel injector 7 for charging or injecting an amount of fuel which conforms with the intake air quantity.

Additionally, provided internally of the combustion chamber of the engine cylinder 1 is a spark plug 8 for producing a spark discharge for triggering combustion of the air-fuel mixture charged in the combustion chamber defined within the cylinder. To this end, the spark plug 8 is electrically connected to an ignition coil 9 which supplies electric energy of high voltage to the spark plug 8.

An exhaust pipe 10 is provided for discharging an exhaust gas resulting from the combustion of the air-fuel mixture within the engine cylinder. An O2-sensor 11 and a catalytic converter 12 are disposed in the exhaust pipe 10. The O2-sensor 11 serves for detecting the content of residual oxygen contained in the exhaust gas.

The catalytic converter or catalyst 12 is constituted by a three-way catalytic converter known by itself is capable of eliminating simultaneously harmful gas components such as HC (hydrocarbon), CO (carbon monoxide) and NOx (nitrogen oxides) contained in the exhaust gas.

A sensor plate 13 designed for detecting the crank angle is mounted on a crank shaft (not shown) so as to corotate therewith. The sensor plate 13 is provided with a projection (not shown) at a predetermined crank angle in the outer periphery thereof.

A crank angle sensor 14 is installed at a position diametrically opposite to the outer periphery of the sensor plate 13 for the purpose of detecting the angular position of the crank shaft in cooperation with the sensor plate 13. Thus, the crank angle sensor 14 can generate an electric signal indicative of the crank angle, i.e., the crank angle signal, every time the projection of the sensor plate 13 passes by the crank angle sensor 14. In this way, the rotating position or angular position (crank angle) of the crank shaft can be detected.

The engine 1 is equipped with valves for putting into communication the intake pipe 4 and the exhaust pipe 10 to each other, wherein the timings for driving the intake or exhaust valves are determined by the cam shafts which are rotated at a speed equal to a half of that of the crank shaft, as will be described later on.

Actuators 15 and 16 for changing adjustably the cam phases are designed to change the timings for driving or actuating the intake or exhaust valves, respectively.

More specifically, each of the actuators 15 and 16 is comprised of a retarding hydraulic chamber and an advancing hydraulic chamber partitioned from each other (described later on) for changing or varying the rotational or angular positions (phases) of the cam shafts 15C and 16C, respectively, relative to the crank shaft.

Cam angle sensors 17 and 18 are disposed at positions diametrically opposite to the outer periphery of cam angle detecting sensor plates (not shown) for the purpose of detecting the angular positions of the cams(i.e., cam angles or phases) through cooperation with the sensor plate. More specifically, each of the cam angle sensors 17 and 18 is designed to generate a pulse signal indicative of the cam angle (i.e., the cam angle signal) in response to a projection formed in the outer periphery of the associated cam angle detecting sensor plate in a similar manner as the crank angle sensor 14 described previously. In this way, it is possible to detect the cam angles (or angular position of the cam shafts).

Oil control valves (also referred to as the OCV in short) 19 and 20 constitute hydraulic pressure supply units in cooperation with oil pumps (not shown) and serve for controlling or regulating the hydraulic pressure supplied to the individual actuators 15 and 16 for thereby controlling the cam phases. Parenthetically, the oil pump is designed to feed oil at a predetermined hydraulic pressure.

An electronic control unit (also referred to simply as the ECU) 21 which may be constituted by a microcomputer or microprocessor serves as a control means for the internal combustion engine system. Among others, the ECU 21 is in charge of controlling the fuel injectors 7 and the spark plugs 8 as well as the cam phases (angular positions of the cams) of the actuators 15 and 16 in dependence on the engine operating states detected by the various sensors such as the air-flow sensor 3, the O2-sensor 11, the crank angle sensor 14 and the cam angle sensors 17 and 18.

Further, provided in association with the throttle valve 5 is a throttle position sensor (not shown in the figure) for detecting the throttle opening degree while a water temperature sensor is provided for the engine 1 for detecting the temperature of cooling water therefor. The throttle opening degree and the cooling water temperature as detected are also inputted to the ECU 21 as the information indicative of the operating state of the engine 1 similarly to the various sensor information mentioned above.

Next, description will be made of the conventional engine control operation performed by the prior art valve timing control system shown in FIG. 12. Firstly, the air flow sensor 3 measures the air quantity (flow rate of the intake air) fed to the engine 1, the output of the air-flow sensor 3 being supplied to the ECU 21 as the detection information indicative of the operating state of the engine.

The electronic control unit or ECU 21 arithmetically determines the fuel quantity or amount which conforms to the air quantity as measured to thereby drive or actuate correspondingly the fuel injector 7. At the same time, the ECU 21 controls the time duration for electrical energization of the ignition coil 18 as well as the timing for interruption thereof to thereby produce a spark discharge at the spark plug 8 for igniting or firing the air-fuel mixture charged within the combustion chamber defined within the engine cylinder at a proper timing.

On the other hand, the throttle valve 5 serves for adjusting or regulating the amount of intake air fed to the engine to thereby control correspondingly the output torque or power generated by the engine 1. The exhaust gas resulting from the combustion of the air-fuel mixture within the cylinder of the engine 1 is discharged through the exhaust pipe 10.

In that case, the catalytic converter 12 disposed within the exhaust pipe 10 at an intermediate location thereof converts the harmful components contained in the exhaust gas such as hydrocarbon (HC) (unburned gas), carbon monoxide (CO) and nitrogen oxides (NOx) into harmless carbon dioxide and water (H2O). In this way, the engine exhaust gas is purified.

In order to make available the maximum purification efficiency of the three-way catalytic converter 12, the O2-sensor 11 is installed in association with the exhaust pipe 10 for detecting the amount of residual oxygen contained in the exhaust gas. The output signal of the O2-sensor 11 is inputted to the electronic control unit or ECU 21 which responds thereto by regulating in a feedback loop the amount of fuel injected through the fuel injector 7 so that the air-fuel mixture which is to undergo the combustion can assume the stoichiometric ratio.

In addition, the ECU 21 controls the actuators 15 and 16 (which constitute parts of the variable valve timing mechanism) in dependence on the engine operating state for regulating the timings at which the intake or exhaust valves are to be driven or actuated.

In the following, referring to FIGS. 13 to 14, description will be made in concrete of the phase angle control operation preformed for the cam shafts 15C and 16C by the conventional valve timing control system for the internal combustion engine.

By the way, in the case of the conventional internal combustion engine of the fixed valve timing scheme (not shown), torque of the crank shaft is transmitted to the cam shafts through the medium of the timing belts (timing chains) and transmission mechanisms including pulleys and sprockets and coupled operatively to the cam shafts for corotation with the pulleys.

By contrast, in the case of the internal combustion engine equipped with the variable valve timing mechanism, there are provided the actuators which are designed to change the relative phase position between the crank shaft and the cam shafts in place of the pulleys and the sprockets mentioned above.

FIG. 13 is a view for illustrating relation between the crank angle [° CA] and the valve lift stroke (indicating the degree of valve opening [mm], (hereinafter also referred to as the valve opening quantity). In the figure, the top dead center in the compression stroke of the cylinder is designated by reference symbol TDC.

In FIG. 13, a single-dotted broken line curve represents change of the valve lift stroke delimited mechanically in the most retarded state, a broken line curve represents change of the valve lift stroke delimited mechanically in the most advanced state, and a solid line curve represents change of the valve lift stroke in a locked state set by a locking mechanism (described hereinafter).

Referring to FIG. 13, it is to be noted that the peak position of the valve lift stroke on the retarded side (righthand side as viewed in the figure) with reference to the top dead center (TDC) corresponds to the fully opened position of the intake valve while the peak position of the valve lift stroke on the advanced side (left-hand side as viewed in the figure) corresponds to the fully opened position of the exhaust valve.

Accordingly, difference in the crank angle between the peaks on the retarded side and the advanced side (i.e., difference between the single-dotted line curve and the broken line curve) represents the range within which the valve timing can be changed (i.e., valve timing adjustable range). To say in another way, the valve timing can be changed or adjusted within the crank angle range defined between the broken line curve and the single-dotted line curve in either of the suction and exhaust operation.

FIG. 14 is a timing chart for illustrating phase or timing relations between the output pulse signal of the crank angle sensor 14 on one hand and that of the cam angle sensor 17 or 18 on the other hand. More specifically, shown in FIG. 14 are the output pulse signals of the cam angle sensor 17 or 18 in both the most retarded state and the most advanced state, respectively, relative to the output of the crank angle sensor.

In this conjunction, it should be added that the phase position of the output signal of the cam angle sensor 17 or 18 relative to the output signal of the crank angle sensor 14 (i.e., crank angle signal) becomes different in dependence on the positions at which the cam angle sensors 17 and 18 are mounted.

At this juncture, it should further be mentioned that retarding of the valve timing means that the valve opening start timings of both the intake or exhaust valves is retarded or delayed relative to (or with reference to) the crank angle, while advancing of the valve timing means that the valve opening start timings of both the valves is advanced relative to the crank angle.

The opening start timings for the intake valve and the exhaust valves can be changed or modified by means of the actuators 15 and 16 which constitute parts of the variable valve timing mechanism to be thereby so controlled as to assume a given retarded position or advanced position within the aforementioned valve timing adjustable or variable range mentioned hereinbefore by reference to FIG. 13.

FIGS. 15 to 17 are views showing internal structures of the actuators 15 and 16 which are implemented in a substantially identical structure. More specifically, FIG. 15 shows the same in a state where the cam phase is adjusted to the most retarded position (corresponding to the state indicated by the single-dotted line curve in FIG. 13), FIG. 16 shows the same in a state where the cam phase is adjusted to the locked or lock-up position (corresponding to the state indicated by the solid line curve in FIG. 13), and FIG. 17 shows the same in a state where the cam phase is adjusted to the most advanced position (corresponding to the state indicated by the broken line curve in FIG. 13), respectively.

Referring to FIGS. 15, 16 and 17, each of the actuators 15 and 16 is comprised of a housing 151 which is rotatable in the direction indicated by an arrow, a vane 152 rotatable together with the housing 151, retarding hydraulic chambers 153 and advancing hydraulic chambers 154 both defined internally of the housing 151, a lock pin 155 and a spring 156 which are also provided within the housing 151, and locking recesses 157 formed in the vane 152.

Power or torque is transmitted to the housing 151 from the crank shaft through the medium of a belt/pulley assembly (not shown) with the speed of rotation being reduced by a factor of 1/2.

The position (phase position) of the vane 152 is caused to shift within the housing 151 in response to the hydraulic pressure supplied selectively to the retarding hydraulic chamber 153 or the advancing hydraulic chamber 154.

The range of operation (hereinafter also referred to as the operation range) of the vane 152 is determined or defined by the retarding hydraulic chamber 153 and the advancing hydraulic chamber 154.

The spring 156 resiliently urges the lock pin 155 in the protruding direction while the locking recess 157 is formed at a predetermined vane lock-up position so that the recess 157 faces in opposition to the tip end of the lock pin 155.

Parenthetically, an oil feed port (not shown) is formed in the locking recess 157 through which the hydraulic medium (i.e., oil in this case) is supplied interchangeably from either one of the retarding hydraulic chamber 153 and the advancing hydraulic chamber 154 within which a higher hydraulic pressure prevails.

The vanes 152 designed to operate within the retarding hydraulic chamber 153 and the advancing hydraulic chamber 154 (i.e., operation range of the vane) and shifted in the angular position or phase are operatively coupled to the cam shafts 15C and 16C for driving the intake or exhaust valves of the engine cylinders.

Although not shown in the drawings, the actuator 16 on the exhaust side is provided with a spring for resiliently urging the vane 152 so that it can assume the advanced position against the reaction force of the cam shaft 16C.

The actuators 15 and 16 are driven under the hydraulic pressure of a lubricant oil of the engine 1 supplied through the oil control valves 19 and 20. For controlling the cam angle phases of the actuators 15 and 16 in such manner as illustrated in FIGS. 15 to 17, the amount of oil (i.e., hydraulic pressure) fed to the actuators 15 and 16 is controlled.

By way of example, regulation of the cam angle phase to the most retarded position, as illustrated in FIG. 15, can be realized by feeding oil into the retarding hydraulic chamber 153. On the contrary, regulation of the cam angle phase to the most advanced position, as illustrated in FIG. 17, can be effectuated by feeding oil into the advancing hydraulic chamber 153.

The oil control valves 19 and 20 are in charge of selecting either the retarding hydraulic chamber 153 or the advancing hydraulic chamber 154 for the oil supply. FIGS. 18, 19 and 21 show in side-elevational sectional views the internal structures of the oil control valves 19 and 20 which are implemented substantially identically.

Referring to FIGS. 18 to 20, each of the oil control valves 19 and 20 is comprised of a cylindrical housing 191, a spool 192 slideably disposed within the housing 191, a solenoid coil 193 for driving continuously the spool 192 and a spring 194 for resiliently urging the spool 192 in the restoring direction.

The housing 191 is provided with an orifice 195 which is hydraulically communicated to a pump (not shown), orifices 196 and 197 hydraulically connected to the actuator 15 or 16, and drain orifices 198 and 199 fluidly communicated to an oil pan.

The orifice 196 can be communicated to the retarding hydraulic chamber 153 of the actuator 15 or the advancing hydraulic chamber 154 of the actuator 16. On the other hand, the orifice 197 can be communicated to the advancing hydraulic chamber 154 of the actuator 15 or the retarding hydraulic chamber 153 of the actuator 16.

The orifices 196 and 197 are selectively put into communication with the oil feeding orifice 195 in dependence on the axial position of the spool 192 (i.e., the position of the spool in the longitudinal direction thereof). In the state shown in FIG. 18, the orifice 195 is shown as having been placed in communication with the orifice 196, while in FIG. 20, the orifice 195 is shown as being communicated to the orifice 197.

Similarly, the drain orifices 198 and 199 are selectively put into communication with the orifice 197 or 196 in dependence on the axial position of the spool 192. In the state shown in FIG. 18, the orifice 197 is shown as being communicated with the orifice 198, while in FIG. 20, the orifice 196 is being communicated to the orifice 199.

The oil feed port formed in the locking recess 157 is so arranged as to be supplied with oil when the oil control valves 19 and 20 are in the electrically driven state (see FIG. 20). More specifically, when the hydraulic pressure applied to the locking recess 157 exceeds the spring force of the spring 156, the lock pin 155 is pushed out from the locking recess 157, whereby the locked state is cleared.

FIG. 18 shows the state in which the electric current flowing through the solenoid or coil 193 is at a minimum value and thus the spring 194 is stretched or relaxed to a maximum extent.

Assuming that the oil control valve shown in FIG. 18 serves as the oil control valve 19 of the intake side, the hydraulic medium or oil supplied from the pump via the orifice 195 flows into the retarding hydraulic chamber 153 of the actuator 15, as a result of which the actuators 15 is shifted to the state illustrated in FIG. 15.

Consequently, the oil resident in the advancing hydraulic chamber 154 of the actuator 15 is forced to flow out through the orifice 197 to be finally discharged to the oil pan by way of the orifice 198.

On the other hand, assuming that the oil control valve shown in FIG. 18 serves as the oil control valve 20 on the exhaust side, the situation is reversed. Namely, the hydraulic medium or oil supplied from the pump via the orifice 196 flows into the advancing hydraulic chamber 154 of the actuator 16, as a result of which the actuators 16 is ultimately set to the state illustrated in FIG. 17.

In that case, the oil contained in the retarding hydraulic chamber 153 of the actuator 16 is forcibly discharged to the oil pan by way of the orifices 197 and 198.

By virtue of the hydraulic circuit arrangement described above by reference to FIG. 18, valve overlap can be suppressed to a minimum even upon occurrence of failure such as shutdown of electric current supply to the oil control valves 19 and 20 disposed at the intake side and the exhaust side, respectively, due to wire breakage or the like. This feature is advantageous from the viewpoint of ensuring high withstandability against the engine stall.

In FIG. 20, the state is illustrated in which where the current flowing through the coil 193 is of a maximum value and thus the spring 194 is compressed to the minimum length.

Assuming, by way of example, that the oil control valve shown in FIG. 20 serves as the oil control valve 19 installed on the intake side, the oil fed from the pump is caused to flow into the advancing hydraulic chamber 154 of the actuator 15 via the orifice 197, whereas the oil in the retarding hydraulic chamber 153 of the actuator 15 is discharged via the orifices 196 and 199.

On the other hand, in the case where the oil control valve shown in FIG. 20 serves as the oil control valve 20 on the exhaust side, the oil fed from the pump is forced to flow into the retarding hydraulic chamber 153 of the actuator 16 via the orifice 197, while the oil in the advancing hydraulic chamber 154 of the actuator 16 is discharged via the orifices 196 and 199.

FIG. 19 shows the state corresponding to the valve timing control end position or lock-up position (mid position). In this state, the vanes 152 of the actuators 15 and 16 are at desired positions, respectively, (see the state illustrated in FIG. 16).

In the state illustrated in FIG. 19, the orifice 195 provided at the oil supply side is not directly communicated to the orifice 196 or 197 disposed on the actuator side. However, due to oil leakage, oil is supplied to the oil feed port of the locking recess 157 (see FIG. 16).

Accordingly, even when the vane 152 is at the lock-up position, there may arise such situation in which the hydraulic pressure applied to the oil feed port under the oil leakage overcomes the spring force of the spring 156 (i.e., exceeds the predetermined unlocking hydraulic pressure value). In that case, the lock pin 155 is caused to disengage from the locking recess 157, allowing the vane 152 to move or operate within the housing 151.

At this juncture, it should be mentioned that the predetermined unlocking hydraulic pressure mentioned above may be set at a necessary minimum value.

Furthermore, the positions (phases) of the vanes 152 of the actuators 15 and 16 which play the role for determining the valve timing can appropriately be controlled by detecting the vane positions by mans of the cam angle sensors 17 and 18.

The cam angle sensors 17 and 18 are mounted at the positions which enable these sensors to detect the relative position between the crank shaft on one hand and the cam shafts 15C and 16C on the other hand.

Referring to FIG. 14, the phase difference relative to the output signal of the crank angle sensor at the position where the valve timing is most advanced (see the broken line curve shown in FIG. 13) is indicated by A, whereas the phase difference relative to the output signal of the crank angle sensor at the position where the valve timing is most retarded (see the single-dotted line curve shown in FIG. 13) is indicated by B.

The ECU 21 is designed or programmed to perform the feedback control so that the phase difference A or B as detected coincides with the desired value, whereby the valve timing control is carried out at given positions.

More specifically, it is assumed, by way of example only, that on the intake side, the detected position of the cam angle sensor 17 relative to the detection timing of the crank angle sensor 14 is retarded with reference to the desired position arithmetically determined by the ECU 21. In that case, the detected position (detection timing) of the cam angle sensor 17 has to be to advanced the desired position. To this end, the amount of the electric current flowing through the coil 193 of the oil control valve 19 is regulated in dependence on the difference between the detected position and the desired position, to thereby control correspondingly the spool 192.

Further, in the case where the difference between the desired position and the detected position is large, the amount of electric current supplied to the coil 193 of oil control valve 19 is increased in order to allow the desired position to be attained speedily.

As a result of this, the aperture of the orifice 197 opened into the advancing hydraulic chamber 154 of the actuator 15 is increased, which results in increasing of the amount of oil fed to the advancing hydraulic chamber 154.

Subsequently, as the detected position approaches to the desired position, the current supply to the coil 193 of the oil control valve 19 is decreased so that the position of the spool 192 of the oil control valve 19 becomes closer to the state illustrated in FIG. 19.

At the time point when coincidence is found between the detected position and the desired position, the electric current supply to the coil 193 is so controlled that the oil flow path leading to the retarding hydraulic chamber 153 and the advancing hydraulic chamber 154 of the actuator 15 is intercepted, as can be seen in FIG. 19.

Incidentally, the desired position in the ordinary engine operation mode (e.g. running state succeeding to the warm-up operation) can be so set or established that optimal valve timing can be realized in accordance with the engine operation state by previously storing, for example, two-dimensional map data values obtained experimentarily in correspondence to the operating states (e.g. engine rotation speeds (rpm) and engine loads), respectively, in a read-only memory or ROM incorporated in the ECU 21.

On the other hand, in the engine starting operation mode, the rotation speed of the oil pump which is driven by the engine 1 is not sufficiently high. Consequently, the volume of the oil fed to the actuator 15 is also insufficient. Thus, the control of the valve timing to the advanced position by controlling the hydraulic pressure as described previously is rendered practically impossible.

Such being the circumstances, jolting or fluttering of the vane 152 due to shortage of the hydraulic pressure has to be prevented by engaging the lock pin 155 with the locking recess 157, as illustrated in FIG. 16.

In that case, if the intake valve is actuated excessively retardingly (i.e., if the valve timing is overretarded), the actual compression ratio becomes lowered while excessive advancing of actuation of the intake valve (i.e., overadvancing of the valve timing) will result in increasing of the time period during which the intake valve and the exhaust valve overlap with each other. In other words, overretarded or overadvanced actuation of the intake valve results in increasing of the pumping loss.

Certainly, the overretarding or overadvancing actuation control of the intake valve can profitably be adopted for increasing the rotation speed in the engine starting operation (e.g. upon cranking) and triggering the initial explosion. However, because the combustion is essentially inadequate, complete combustion or explosion is difficult to realize.

On the other hand, overretarding of actuation of the exhaust valve will result in increasing of the overlap period during which the intake valve and the exhaust valve overlap with each other, similarly to the case where operation of the intake valve is advanced excessively. By contrast, overadvancing of the exhaust valve actuation will incur lowering of the actual expansion ratio, rendering it impossible to transmit the combustion energy sufficiently to the crank shaft.

As is apparent from the above, overretarding or overadvancing control of the valve timing in the engine starting operation or immediately thereafter may unwantedly incur degradation of the engine starting performance or the state incapable of starting the engine operation in the worst case.

Thus, for coping with the problems such as mentioned above in the engine starting operation, the vane 152 is fixedly set at the lock-up position (i.e., nearly mid position between the most retarded position and the most advanced position) by engaging the lock pin 155 into the locking recess 157, as shown in FIG. 16.

In that case, since the hydraulic pressure of the lubricating oil increases as the engine rotation speed (rpm) increases in succession to starting operation of the engine, the hydraulic pressure is fed to the actuators 15 and 16 because of the oil leakage described previously even in the state where the spool 192 is at the position shown in FIG. 19.

Such being the circumstances, when the hydraulic pressure applied to the locking recess 157 overcomes the spring force of the spring 156, the lock pin 155 is caused to disengage from the locking recess 157, allowing the vane 152 to move.

Thus, by controlling the oil control valves 19 and 20 after unlocking of the vanes, the hydraulic pressure fed to the retarding hydraulic chamber 153 and the advancing hydraulic chamber 154 can be regulated, whereby the valve timing retarding or advancing control can be carried out.

In that case, particularly in the high-speed rotation range of the engine 1, the valve timing is so controlled as to be retarded more when compared with the engine starting operation for the purpose of realizing the suction inertia effect as well as enhancement of the volumetric efficiency and hence the output performance of the engine.

As can be appreciated from the foregoing, in the engine starting operation, the lock pins 155 of the actuators 15 and 16 are locked at a nearly mid position between the most retarded position and the most advanced position with a view to enhancing the engine starting performance. On the other hand, once the engine operation has been started after releasing of the locking mechanism, the valve timing is so controlled as to be retarded especially in the high-speed rotation range of the engine.

However, in the conventional valve timing control system for the internal combustion engine, no consideration has been given to such technical matters as improvement of the exhaust gas quality and promotion of temperature rise of the catalyst.

The conventional valve timing control system for an internal combustion engine is configured as described above. In an engine starting operation, the valve timing control system engages with a substantially intermediate position between a most advanced position and a most retarded position by the locking mechanism of the actuator, thereby improving a starting performance of the internal combustion engine. After the engine operation has been started, when the locking mechanism is released, the valve timing control system improves an output performance of the internal combustion engine by controlling the valve timing toward a more retarded state than in the starting operation, in particular, in a high rotational range.

In addition, Japanese Patent Application Laid-open No. Hei 11-210424 describes that, after the lock pin is released, a control of valve timing executes a feedback control for making a detected advance angle amount coincide with a target advance angle amount.

On the intake side, if the detected advance angle amount is in a more retarded state than the target advance angle amount, the valve timing control system controls the OCVs 19 and 20 to supply oil to the advancing hydraulic chamber of the actuator in order to advance the valve timing. As a result, the OCVs are capable of successively controlling the spool 192 to be set to an arbitrary position by an amount of energizing current to the coil 193 as shown in FIG. 20, thereby successively controlling an amount of oil to be supplied from an oil pump to the actuators 15 and 16.

If the detected advance angle amount is in a more advanced state than the target advance angle amount, the valve timing control system controls the OCVs to supply oil to the retarding hydraulic chamber of the actuator as shown in FIG. 18 so that the valve timing is retarded. In addition, if the detected advance angle amount substantially coincides with the target advance angle amount, the valve timing control system controls both the advancing hydraulic chamber 154 and the retarding hydraulic chamber 153 to be set to positions for blocking a passage as shown in FIG. 19.

If the target advance angle amount is in a pin-lock-up position, the lock pin 155 is in the position of the locking recess 157, and most of the passages of the OCVs 19 and 20 are blocked. Thus, since a hydraulic pressure decreases by a large degree and a hydraulic pressure applied to the lock pin 155 also decreases, the lock pin 155 is locked in the locking recess 157 if a force caused by the hydraulic pressure applied on the lock pin 155 becomes smaller than a spring force.

Here, in the case in which an integral control is executed in order to make the detected advance angle amount coincide with the target advance angle amount, the detected advance angle amount is locked by the lock pin 155 if there is only a slight difference between the pin lock-up position and the target advance angle amount when the lock pin 155 is locked. Thus, the detected advance angle amount does not move despite the fact that an integrated value is increased or decreased, and the integrated value is increased or decreased to a limit of a control range. When the target advance angle amount changes and it is intended to make the detected advance angle amount follow the change, the detected advance angle amount may not be able to follow the target advance angle amount promptly because a control value diverges.

In addition, when passages to the actuators of the OCVs are secured and a hydraulic pressure to the lock pin 155 reaches a hydraulic pressure sufficient to release a lock before the integrated value reaches the limit of the control range, the pin lock is released and a control amount deviates largely due to a movement of the integrated value at this point. Thus, the detected advance angle amount may deviate largely from the target advance angle amount simultaneously with the release of the lock pin.

SUMMARY OF THE INVENTION

In the conventional valve timing control system for the internal combustion engine, no consideration is given to the improvement of the exhaust gas quality and the acceleration or promotion of temperature-rise of the catalyst, as described above. To say in another way, the conventional valve timing control system suffers problems that the catalyst temperature can not sufficiently be increased and that the quality of the exhaust gas yet remains to be improved.

In view of the above and other objects which will become apparent as the description proceeds, there is provided according to an aspect of the present invention a valve timing control system for an internal combustion engine, which system includes sensor means for detecting engine operation states of an internal combustion engine, intake or exhaust cam shafts for driving intake or exhaust valves, respectively, of the internal combustion engine in synchronism with a rotation of a crank shaft of the internal combustion engine, at least one actuator operatively connected to at least one of cam shafts for driving the intake or exhaust valves, respectively, a hydraulic pressure supply unit for feeding a hydraulic pressure to drive the actuator; and control means for controlling the hydraulic pressure fed from the hydraulic pressure supply unit to the actuator in dependence on the operating states of the internal combustion engine while changing a relative phase of the cam shaft relative to the crank shaft, wherein the actuator includes a retarding hydraulic chamber and an advancing hydraulic chamber for setting an adjustable range of the relative phase, a locking mechanism for setting the relative phase to a lock-up position within the adjustable range, and an unlocking mechanism for releasing the locking mechanism in response to a predetermined level of hydraulic pressure fed from the hydraulic pressure supply unit, and the control means restricts control of a valve timing within a predetermined range of a lock-up position in the locking mechanism.

Further, restraining the control means not executing steady control.

Furthermore, the control means detects a detected advance angle amount that is a phase difference between phases of the crank shaft and the cam shaft and calculates a target advance angle amount that is valve timing suitable for an operating state of the internal combustion engine not to set the target advance angle amount in a predetermined range of the lock-up position of the locking mechanism in the case in which the control means controls such that the detected advance angle amount substantially coincides with the target advance angle amount.

Still further, the predetermined range is at least a variation range of steady control or the variation range of the steady control and an amount of a clearance by the locking mechanism.

Yet still further, the steady control is not executed only when the operating state of the internal combustion engine is in a predetermined sate.

Furthermore, the control means corrects a control amount with respect to a normal time if the detected advance angle amount is within a range allowing for a steady variation and an amount of a clearance from the lock-up position.

In addition, the correction of the control amount is performed such that an acting speed increases.

Finally, if there is a delay from the time when the control amount is changed until the time when a detected advance angle amount changes, the control means corrects the control amount earlier by a time corresponding to the delay.

DESCRIPTION OF THE PREFERRED EMBODIMENTS

Figure 1:
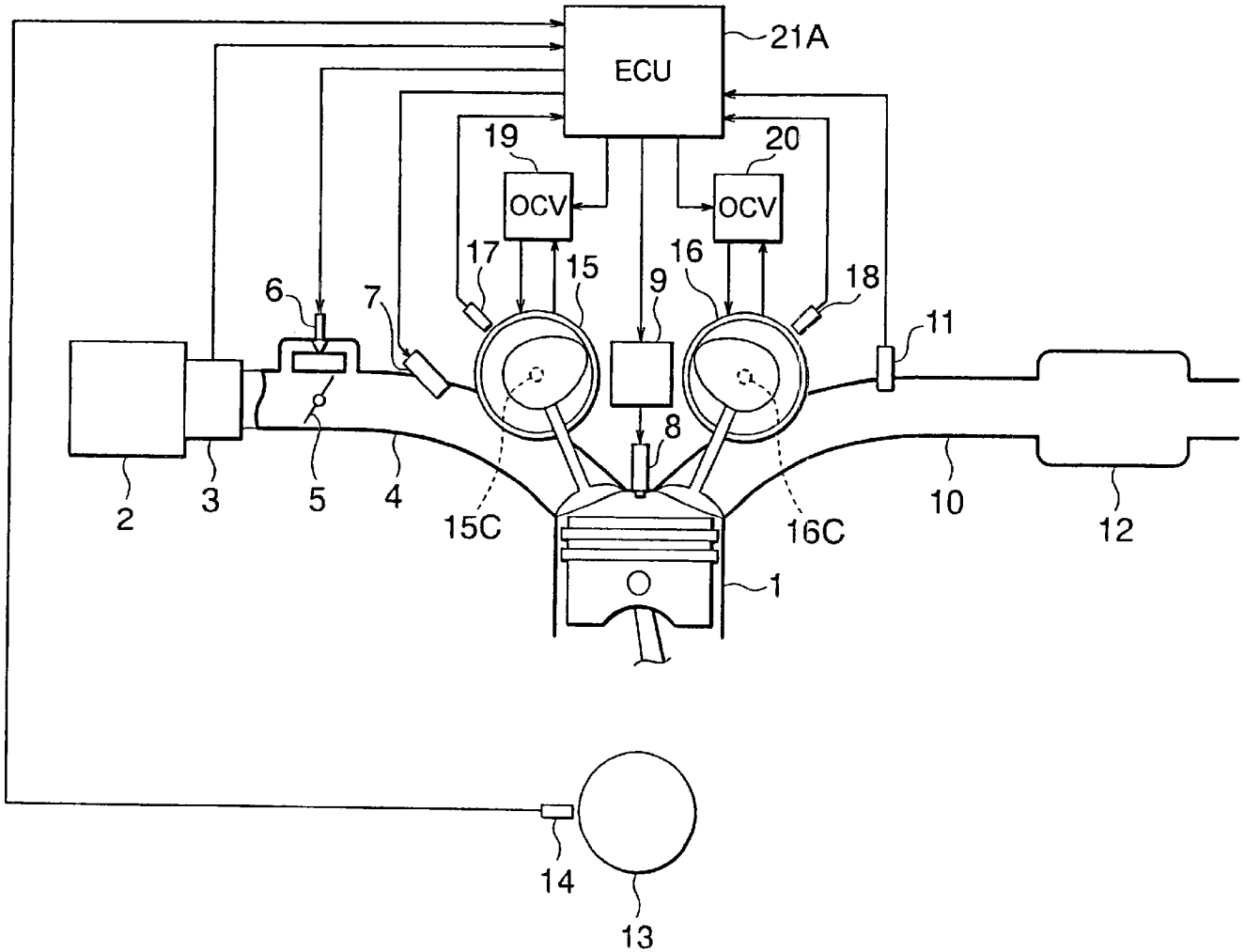
FIG. 1 is a block diagram showing a configuration of a valve timing control system for an internal combustion engine in the present invention.

The present invention will be described in detail in conjunction with what is presently considered as preferred or typical embodiments thereof by reference to the drawings. In the following description, like reference characters designate like or corresponding parts throughout the several views.

Embodiment 1

In the following, a valve timing control system for an internal combustion engine according to a first embodiment of the present invention will be described in detail by reference to the drawings.

Figure 12:
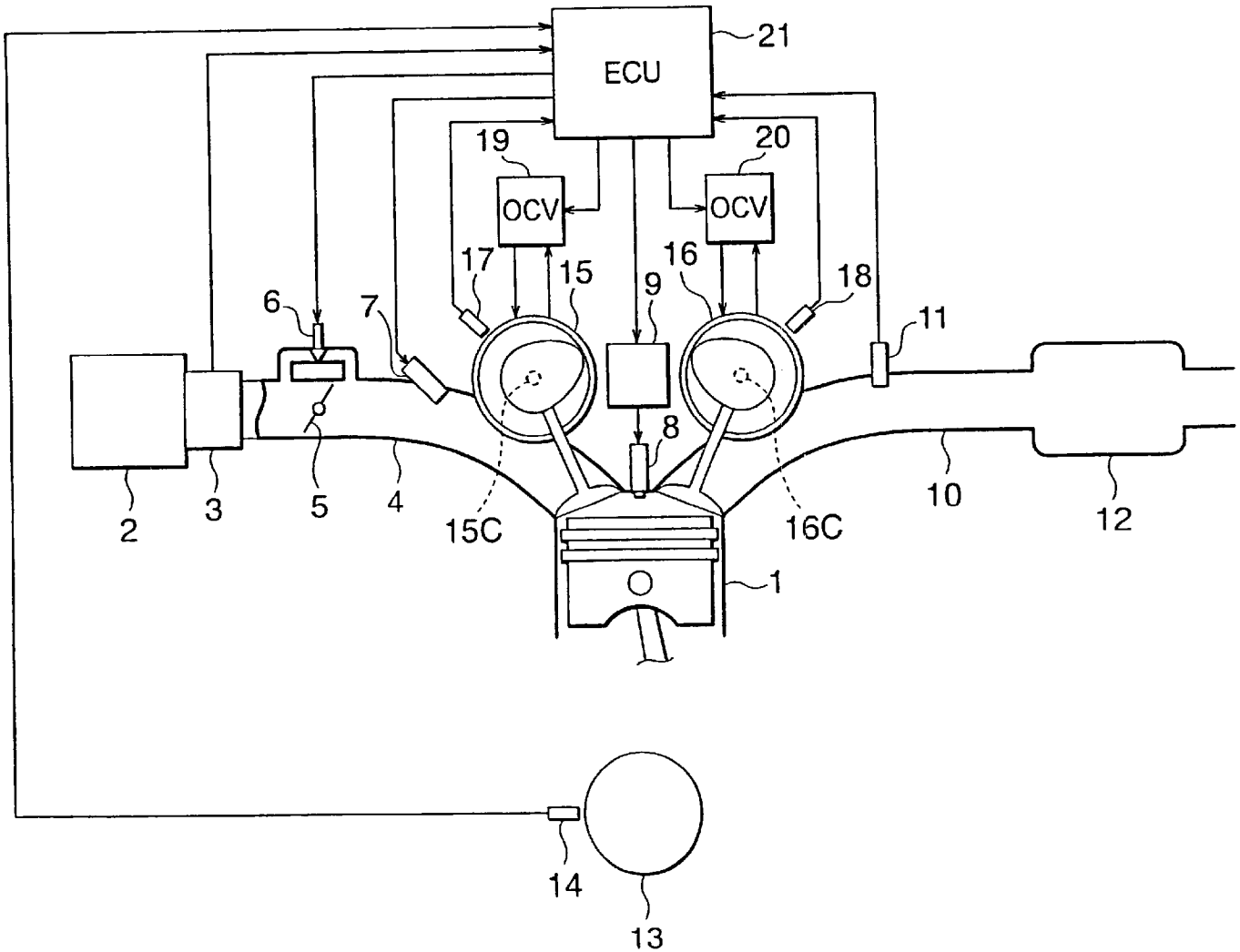
FIG. 12 is a functional block diagram showing generally and schematically a configuration of a conventional valve timing control system of an internal combustion engine known heretofore.

FIG. 1 is a schematic block diagram showing generally a configuration of the valve timing control system for the internal combustion engine according to the first embodiment of the invention. In the figure, components same as or equivalent to those mentioned hereinbefore by reference to FIG. 12 are denoted by like reference characters as those used in this figure and detailed description thereof is omitted.

Figure 13:
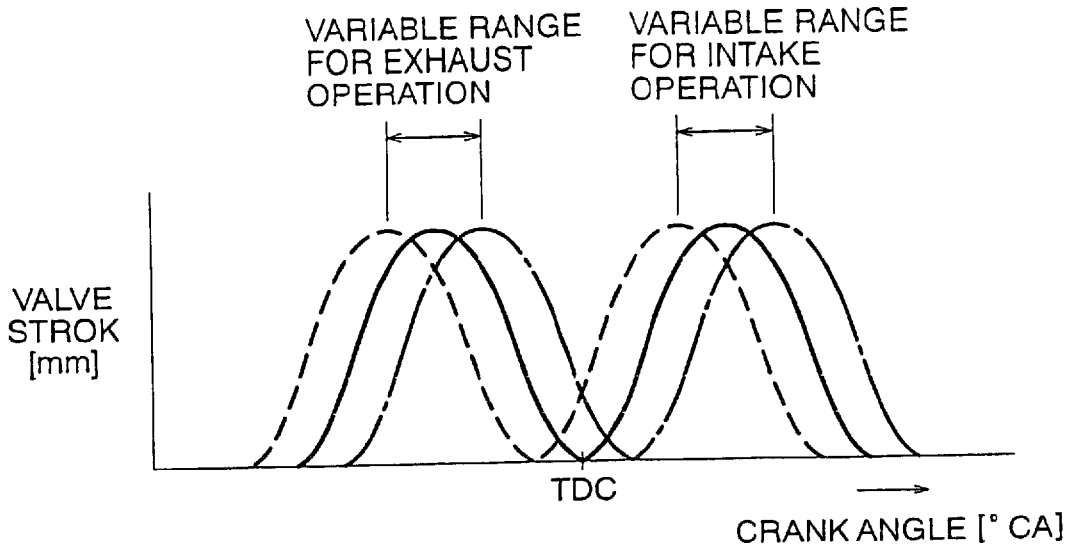
FIG. 13 is a view for illustrating a phase adjustable range of the conventional valve timing control system in terms of relation between crank angles and valve lift strokes.
Figure 14:
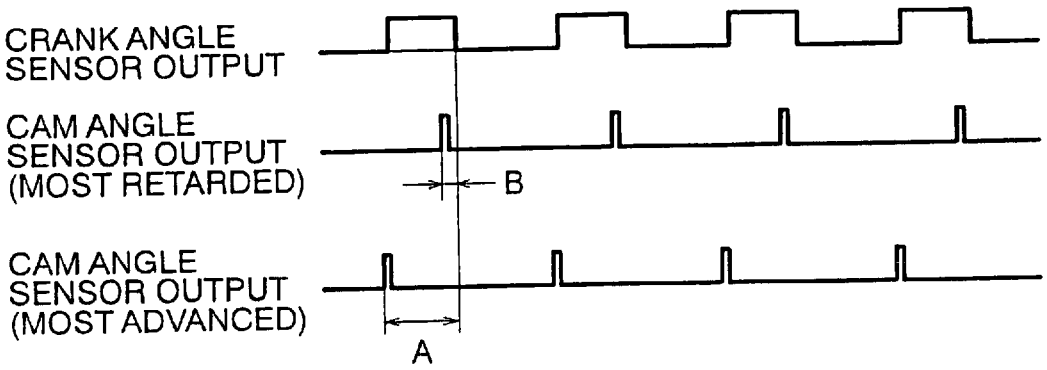
FIG. 14 is a timing chart for illustrating conventional phase or timing relations between individual output pulse signals of a crank angle sensor and cam angle sensors.

Accordingly, in the valve timing control system for the internal combustion engine according to the instant embodiment of the invention, the change control range of the valve timings for the intake valve and the exhaust valve is essentially same as shown in FIG. 13, and the relation between the output of the crank angle sensor and that of the cam angle sensor is also same as shown in FIG. 14.

Figure 15:
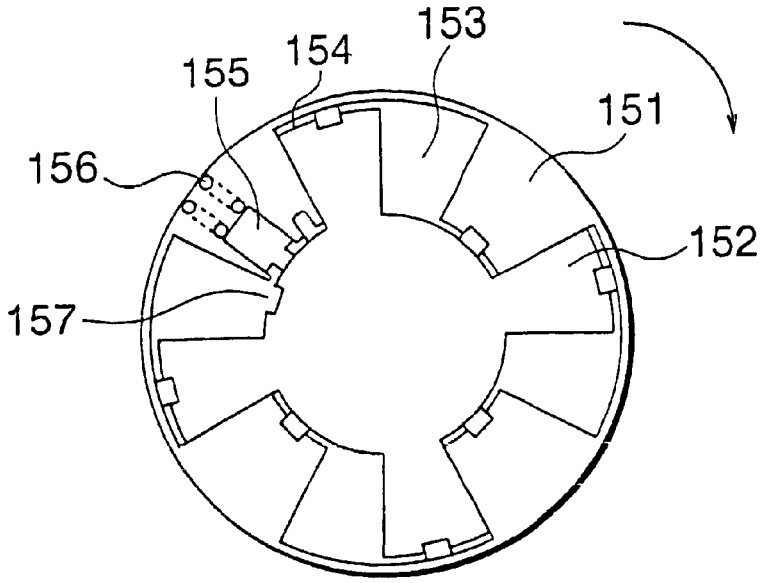
FIG. 15 is a perspective view showing an internal structure of a conventional actuator at a most retarded timing position.
Figure 16:
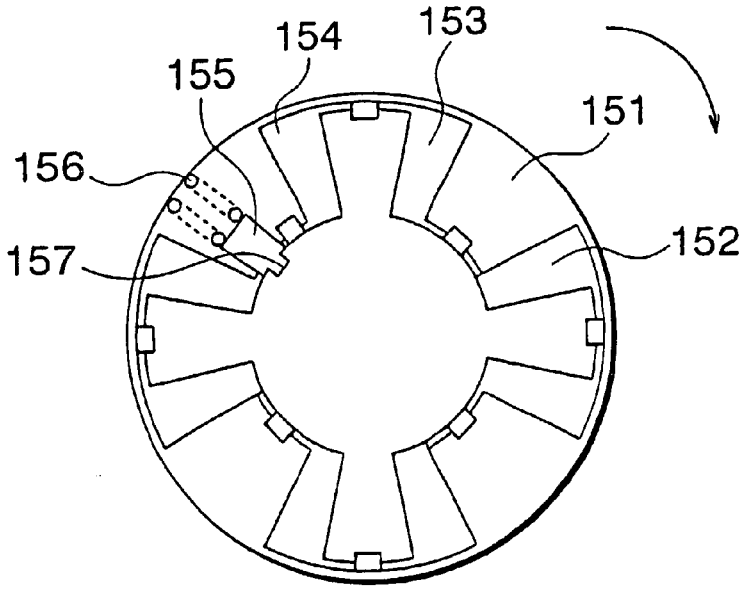
FIG. 16 is a perspective view showing an internal structure of the conventional actuator at a lock-up position.
Figure 17:
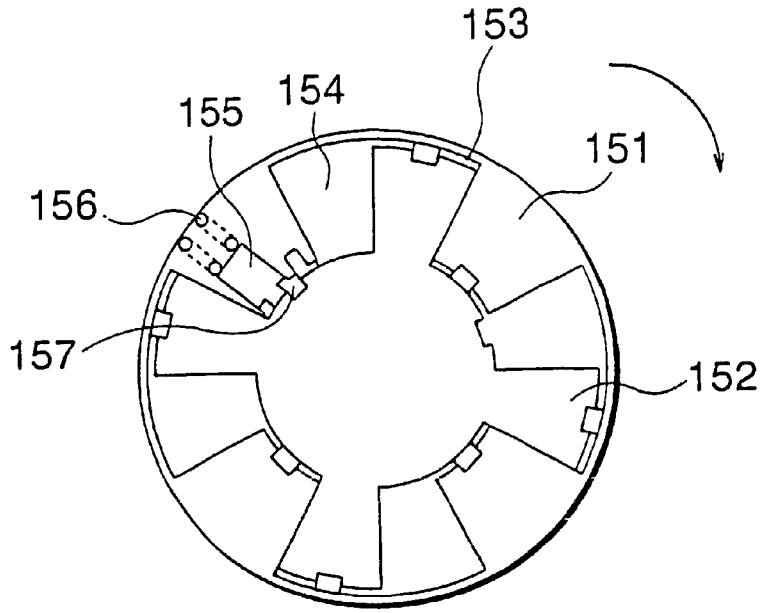
FIG. 17 is a perspective view showing an internal structure of the conventional actuator at a most advanced timing position.
Figure 18:
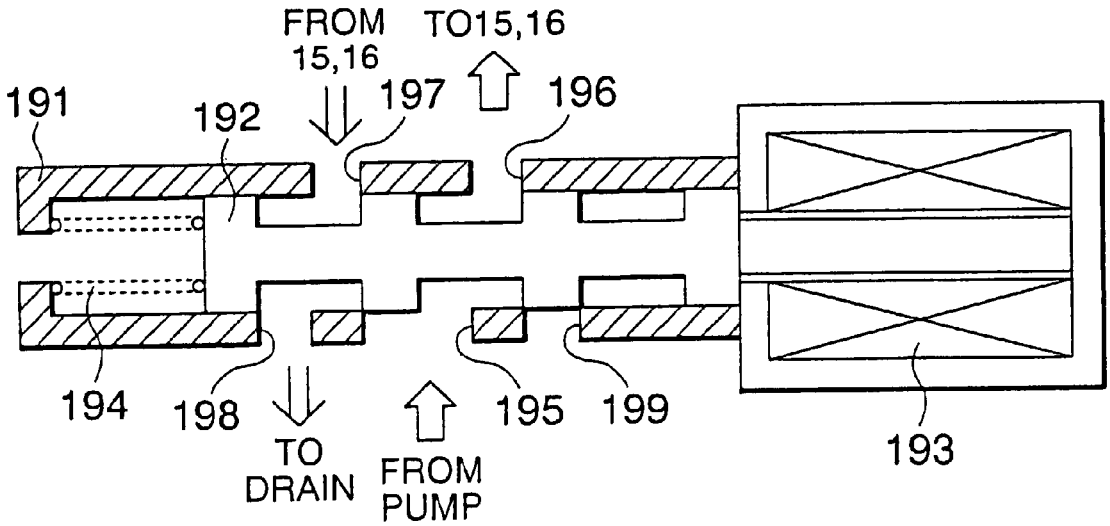
FIG. 18 is a side-elevational sectional view showing an internal structure of a conventional oil control valve unit (hydraulic pressure supply unit) in an electrically deenergized state.

Further, the structure of the actuators 15 and 16 are essentially identical with that shown in FIGS. 15, 16 and 17. Besides, the structures of the oil control valves (OCV) 19 and 20 are also essentially identical with those described hereinbefore in conjunction with FIGS. 18, 19 and 20.

Now, referring to FIG. 1, an electronic control unit (also referred to as the ECU in short) 21A shown in FIG. 1 includes a lock control means for setting the actuators 15 and 16 to the lock-up position or state by means of the locking mechanism and an unlock control means for performing retarding or advancing control of the actuators 15 and 16 after the actuators 15 and 16 are released from the lock-up state by means of an unlocking mechanism in succession to the engine starting operation, as described hereinbefore.

Moreover, the ECU 21A includes restricting means for not executing but restricting steady control of a valve timing within a predetermined range of a position where the lock pin 155 engages with the locking recess 157. This prevents a control amount from dispersing due to hitching of the lock pin by not executing the control in a pin lock-up position of an actuator, thereby making full use of engine performance to prevent deterioration of its driveability, and decrease in its mileage and gas exhausting performance.

In a running mode after warm-up or the like that is a normal driving mode, a target advance angle amount can be an optimum valve timing in each driving mode if, for example, a map of a target advance angle amount that is two-dimensionally mapped by a rotation and a load of an engine is stored in an ROM of the ECU 21 in advance and target advance angle amounts according to driving states are set in the map.

Since an oil pump is driven by an engine, the number of rotations of the oil pump is not enough in the engine starting operation and an oil amount supplied to the actuator is insufficient. Thus, a control of an advanced position is impossible. Therefore, flopping of the vane 152 due to insufficient hydraulic pressure is prevented by engaging the lock pin 155 with the locking recess 157 as shown in FIG. 16.

There is a valve timing suitable for starting in the starting operation, and it is intended that an engagement position by the lock pin 155 becomes a valve timing in the starting operation. A valve overlap becomes large if an intake valve is excessively advanced and an actual compression ratio decreases if the intake valve is excessively retarded. In each case, the number of rotation in the cranking operation increases due to the decrease of a pumping loss, which is advantageous to an initial explosion but may not lead to a complete explosion because subsequent explosions are insufficient.

When an exhaust valve is excessively advanced, the actual compression ratio decreased and combustion energy cannot be transmitted to a crank sufficiently. When the exhaust valve is excessively retarded, a valve overlap becomes large and the same situation arises as in the case in which the intake valve is excessively advanced. In the starting operation or in the operation state which immediately succeeds to the starting operation, the starting performance is deteriorated or starting becomes impossible if the valve timing is either excessively advanced or excessively retarded. Therefore, the valve timing is locked by the lock pin 155 such that it becomes favorable in the starting operation or in the operation state which immediately succeeds to the starting operation.

After the starting operation, a hydraulic pressure increases in response to the increase of an engine speed and the hydraulic pressure is also supplied to the actuator. When the hydraulic pressure is supplied to the actuator, the hydraulic pressure is also supplied to the locking recess 157. Then, when the hydraulic pressure overcomes the force of the spring 156, the lock pin 155 is released from the locking recess 157 and the vane 152 is made to be operable. Thus, the OCVs 19 and 20 are for regulating control the supply of the hydraulic pressure to the retarding hydraulic pressure chamber 153 and the advancing hydraulic pressure chamber 154, whereby an advance angle and an retard angle can be controlled.

Figure 19:
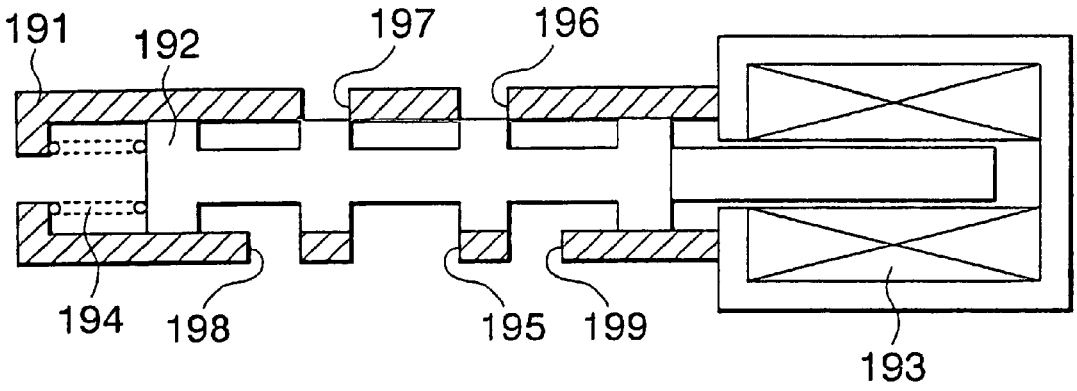
FIG. 19 is a side-elevational sectional view showing an internal structure of the conventional oil control valve unit in a lock-up state.
Figure 20:
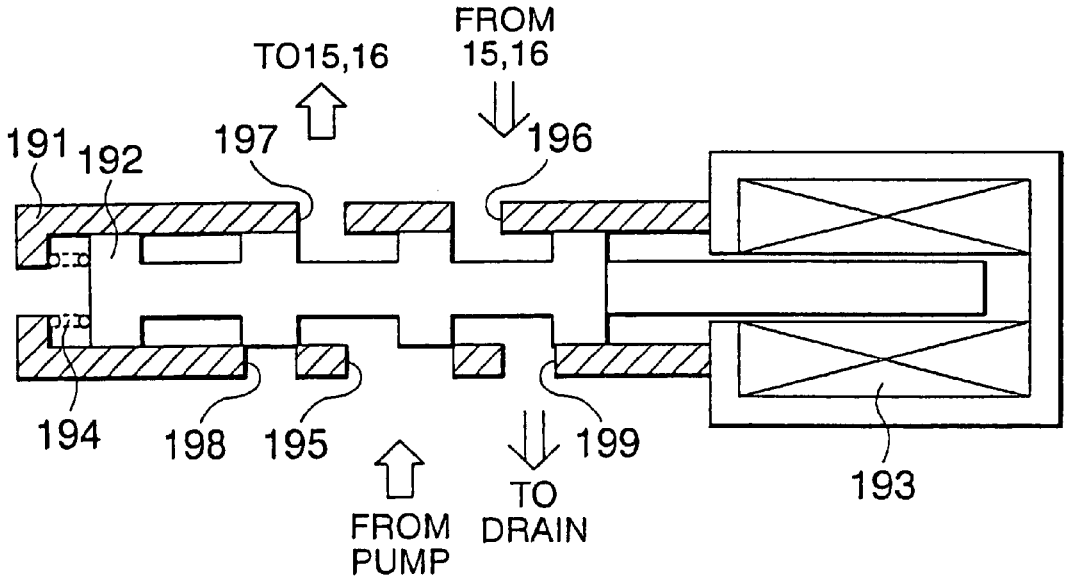
FIG. 20 is a side-elevational sectional view showing an internal structure of the conventional oil control valve unit in an electrically energized state.

If a feedback control is executed according to a deviation of a target advance angle and a detected advance angle, a control value at the time of a holding control that is substantially indicated by a situation of FIG. 19 is learnt, and the control is executed on the basis of the learnt value. The learning is executed in order to stabilize the control even if there are dispersions in which a control value at the time of the holding control varies for each engine. The learning is executed based on an integrated value at the time of the holding control, and if the learning is not executed, the integrated value fluctuates largely due to the dispersions. Thus, a certain degree of range is required for a width of an integral control.

Depending on engine operating states, the target advance angle amount gets close to the pin lock-up position. When the detected advance angle amount follows the target advance angle amount, the OVC is controlled in the position shown in FIG. 19. In this case, since passages to both an advance angle and a retard angle are blocked and a hydraulic pressure by a leaked amount from the OCV is supplied to the actuator, the hydraulic pressure drops significantly and the force of the sprint 156 overcomes the hydraulic pressure to bring the lock pin 155 in the locking recess 157. When the integral control is executed in this state, since the detected advance angle amount does not change in spite of changing a control current, the control current disperses. Thus, a control for preventing the dispersion of the control current is required.

A valve timing control on an intake side according to a first embodiment of the present invention will now be described with reference to a flow chart of FIG. 2 together with the above-mentioned FIGS. 13 to 20. This processing is executed for each predetermined timing (e.g., 25 [ms]) in the ECU 21A.

First, in step S201, the ECU 21A detects a detected advance angle amount Vd that is a phase difference between a phase of a crank shaft and a phase of a cam shaft. This corresponds to A and B in FIG. 14. Then, in step S202, the ECU 21A calculates a target advance angle amount Vt that is a valve timing suitable for an engine operating state from a charging efficiency, which is a loading state in an engine, and an engine speed.

Then, if it is determined by a determination in step S203 that the target advance angle amount Vt is smaller than a lock-up position Vr and is larger than a position apart from the lock-up position by an amount that allows for a steady variation Vc and an amount of a clearance Vg between a lock pin 155 and a locking recess 157 (Vr−(Vc+Vg/2)), the ECU 21A sets the target advance angle amount Vt to a position that allows for the steady variation Vc, the amount of a clearance Vg between the lock pin 155 and the locking recess 157 and at least an amount of 1LSB $\alpha$(Vr−(Vc+Vg/2)−$\alpha$) in step S204.

On the other hand, if it is determined in step S205 that the target advance angle amount Vt is larger than the lock-up position Vr and smaller than a position apart from the lock-up position by an amount that allows for a steady variation Vc and an amount of a clearance Vg between a lock pin 155 and a locking recess 157 (Vr+(Vc+Vg/2)), the ECU 21A sets the target advance angle amount Vt to a position that allows for the steady variation Vc, the amount of a clearance Vg between the lock pin 155 and the locking recess 157 and at least the amount of 1LSB $\alpha$(Vr+(Vc+Vg/2)+$\alpha$) in step S206.

That is, if the target advance angle amount Vt enters a range of Vr to Vr−(Vc+Vg/2), the ECU 21A sets the target advance angle amount Vt to Vr−(Vc+Vg/2)−$\alpha$, and if the target advance angle amount Vt enters a range of Vr to Vr+(Vc+Vg/2), the ECU 21A sets the target advance angle amount Vt to Vr+(Vc+Vg/2)+$\alpha$, thereby not setting the target advance angle amount Vt within a range of Vr−(Vc+Vg/2) to Vr+(Vc+Vg/2).

The ECU 21A subtracts the detected advance angle amount Vd from the target advance angle amount Vt to find a control deviation Ver in the next step S207. Then, the ECU 21A determines in step S208 if the control deviation Ver is within a range of a steady variation (−Vc to Vc). If the control deviation is within the range of the steady variation, the ECU 21A determines that the valve timing control is in a holding mode in step S210. On the other hand, if the control deviation is not within the range of the steady variation, the ECU 21A determines that the valve timing control is in a PD (proportional differential) mode in step S209.

Figure 2:
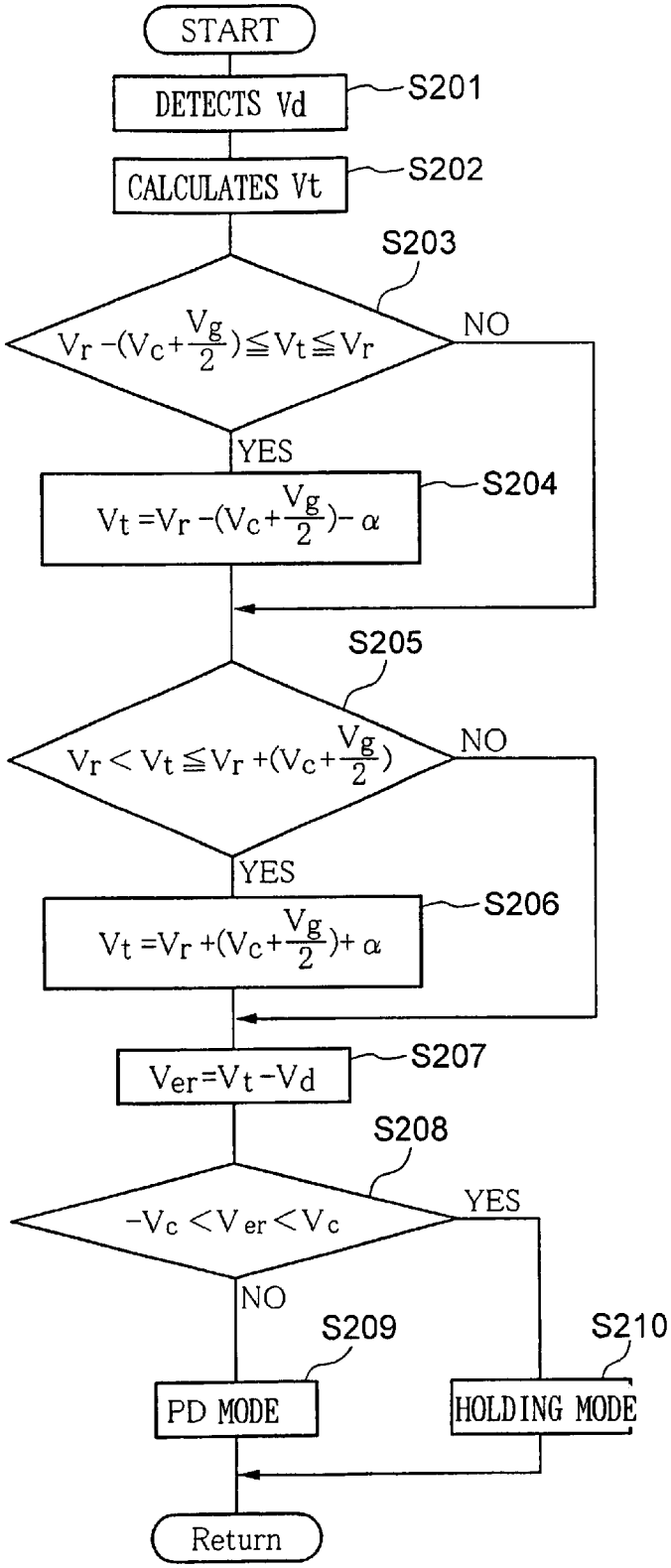
FIG. 2 is a flow chart showing control operations of an ECU 21A in accordance with a first embodiment of the present invention.
Figure 3:
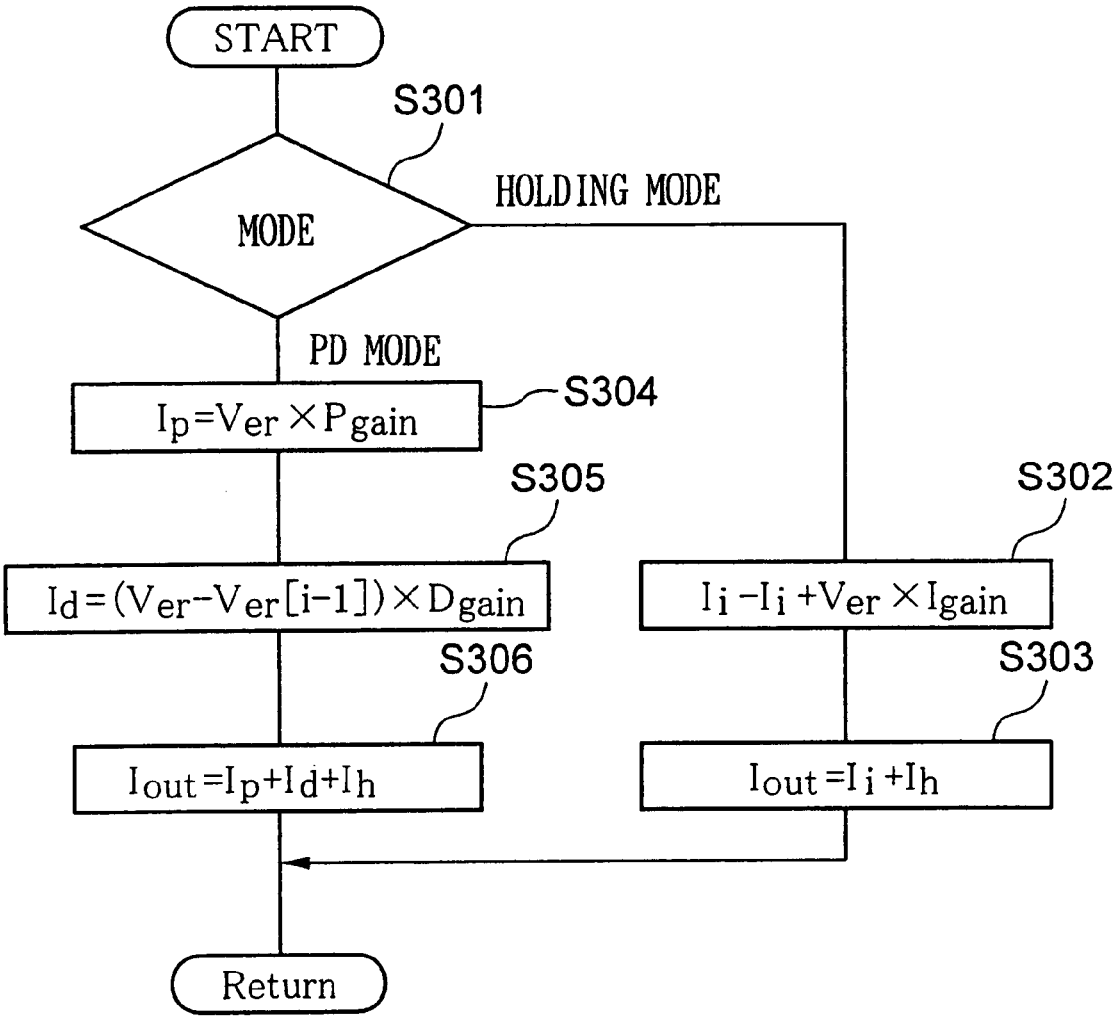
FIG. 3 is a flow chart showing processing after determining a mode in FIG. 2.

FIG. 3 is a flow chart showing processing after determining a mode in FIG. 2. If it is determined in step S301 that the valve timing control is in the holding mode, the ECU 21A adds a product of the control deviation Ver and an integral gain Igain to an integrated value Ii to calculate a new integrated value Ii in step S302. The integral gain Igain is a value set in advance and stored in an ROM. Then, the ECU 21A adds the integrated value Ii and a holding current learnt value Ih to calculate a control output value Iout in step S303. The holding current learnt value Ih is a value found by learning the control output value Iout in the state in which the target advance angle amount Vt and the detected advance angle amount Vd substantially coincide with each other at the time of the holding mode.

On the other hand, if it is determined in step S301 that the valve timing control is in the PD mode, the ECU 21A multiplies the control deviation Ver and a proportional gain Pgain to calculate a proportional value Ip. Then, the ECU 21A multiplies a difference found by subtracting the last control deviation Ver[i−1] from the control deviation Ver by a differential gain Dgain to calculate a differentiated value Id in step S305. The proportional gain Pgain and the differential gain Dgain are values set in advance and stored in an ROM. Then, the ECU 21A adds the proportional value Ip, the differentiated value Id and the holding current learnt value Ih to find a the control output value Iout in step S306. The holding current learnt value Ih is the same as the holding current learnt value Ih in step S303.

The control output value Iout calculated in the PD mode or the control output value Iout calculated in the holding mode is converted to a duty ratio to be outputted to the OCV and controlled.

Figure 4:
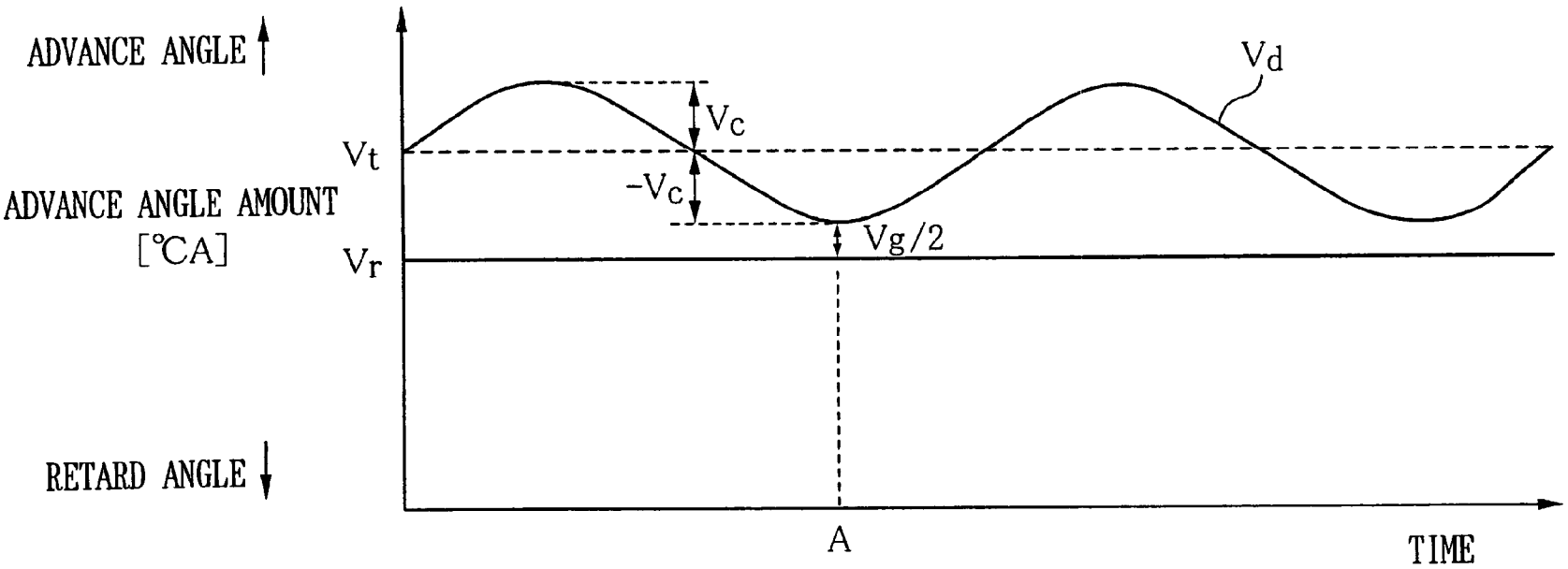
FIG. 4 is a diagram illustrating movement of a detected advance angle amount Vd with respect to a target advance angle amount Vt.

In FIGS. 4 to 7, the target advance angle amount Vt will be described concerning the necessity of allowing for the steady variation Vc and the clearance Vg between the lock pin 155 and the locking recess 157. FIG. 4 is a diagram showing a movement of the detected advance angle amount Vd relative to the target advance angle amount Vt. The detected advance angle amount Vd is controlled relative to the target advance angle amount Vt according to a deviation within the range of the variation (−Vc to Vc) by an integral control. A clearance is provided between the lock pin 155 and the locking recess 157, and a difference of the internal diameter of the locking recess 157 and the external diameter of the lock pin 155 is the clearance Vg. Even if the lock pin 155 is engaged with the locking recess 157, the amount of the clearance (−Vg/2 to Vg/2) varies around the pin lock position Vr.

Figure 5:
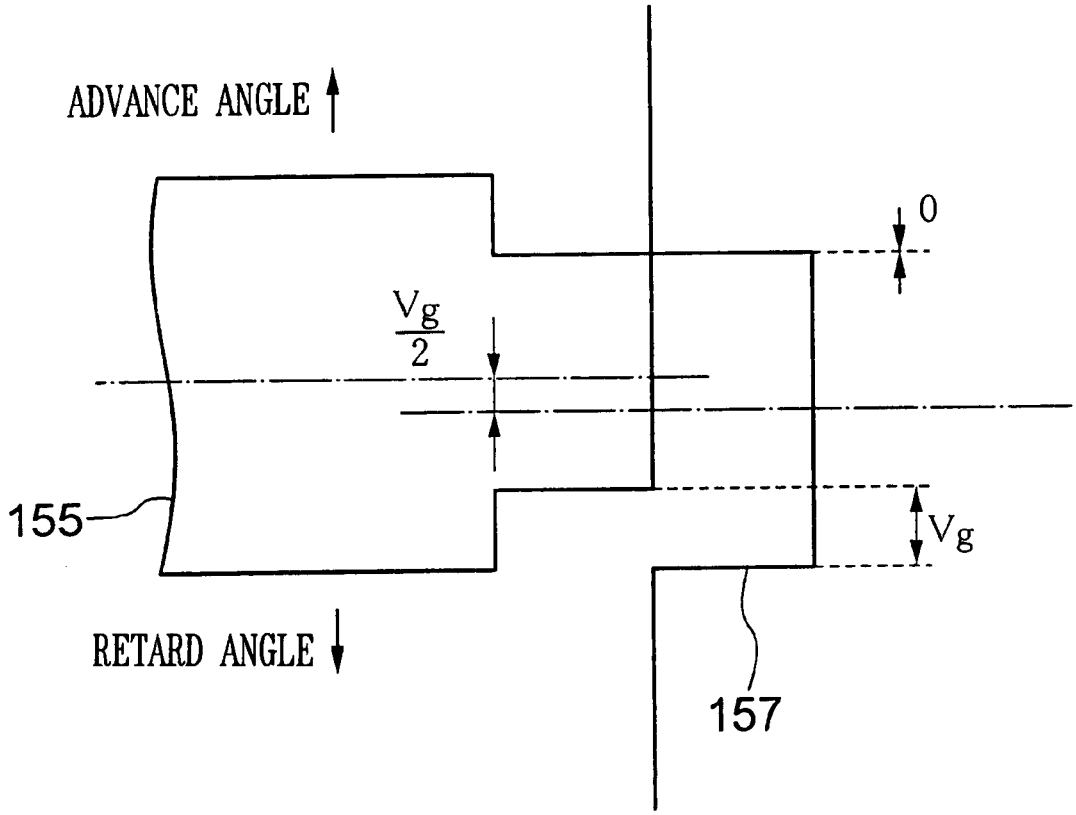
FIG. 5 is a diagram illustrating a positional relation between a lock pin 155 and a locking recess 157 in the state in which a target advance angle amount Vt approaches a pin lock-up position Vr most (a point in time A of FIG. 4) with the target advance angle amount Vt assumed to be in a position apart from the pin lock-up position Vr by amounts of a steady variation Vc and a clearance Vg.

FIG. 5 shows a positional relation between a lock pin 155 and a locking recess 157 in the state in which a target advance angle amount Vt approaches a pin lock-up position Vr most (a point in time A of FIG. 4) with the target advance angle amount Vt assumed to be in a position apart from the pin lock-up position Vr by amounts of a steady variation Vc and a clearance Vg. In the positional relation of FIG. 5, since the clearance on the advance side becomes zero, the lock pin 155 is engaged with the locking recess 157.

Figure 6:
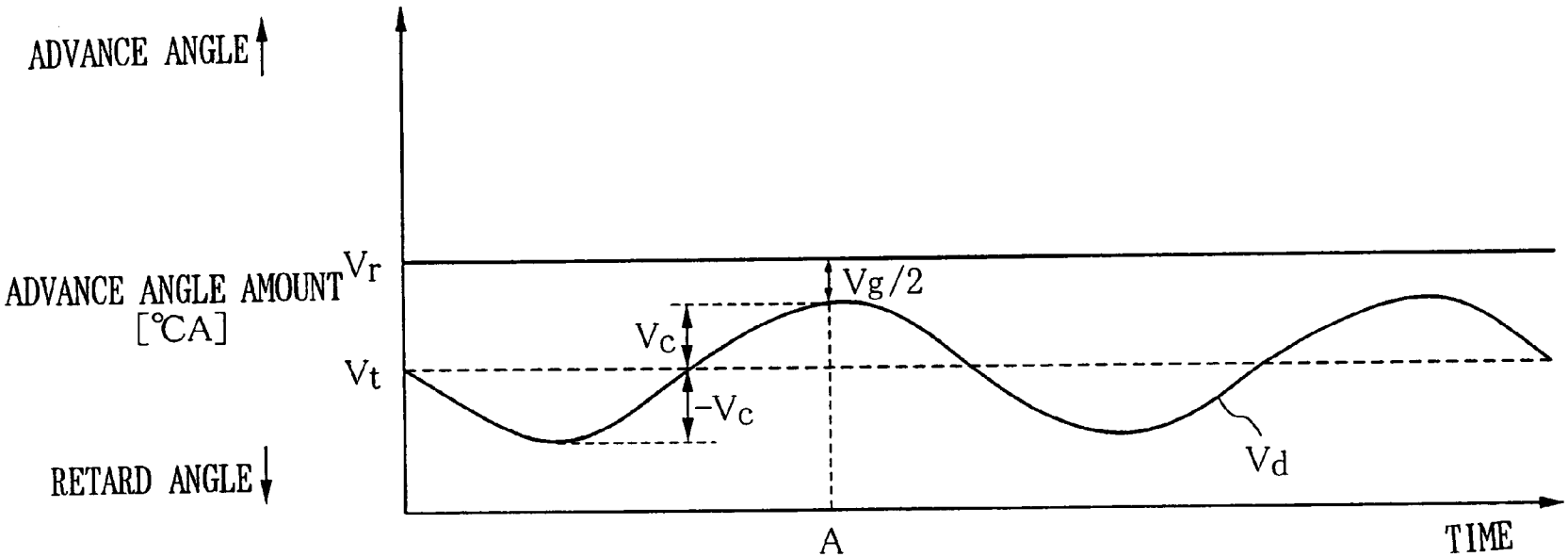
FIG. 6 is a diagram illustrating the case in which the target advance angle amount Vt is on a retard side with respect to the pin lock-up position Vr contrary to the case of FIG. 4.
Figure 7:
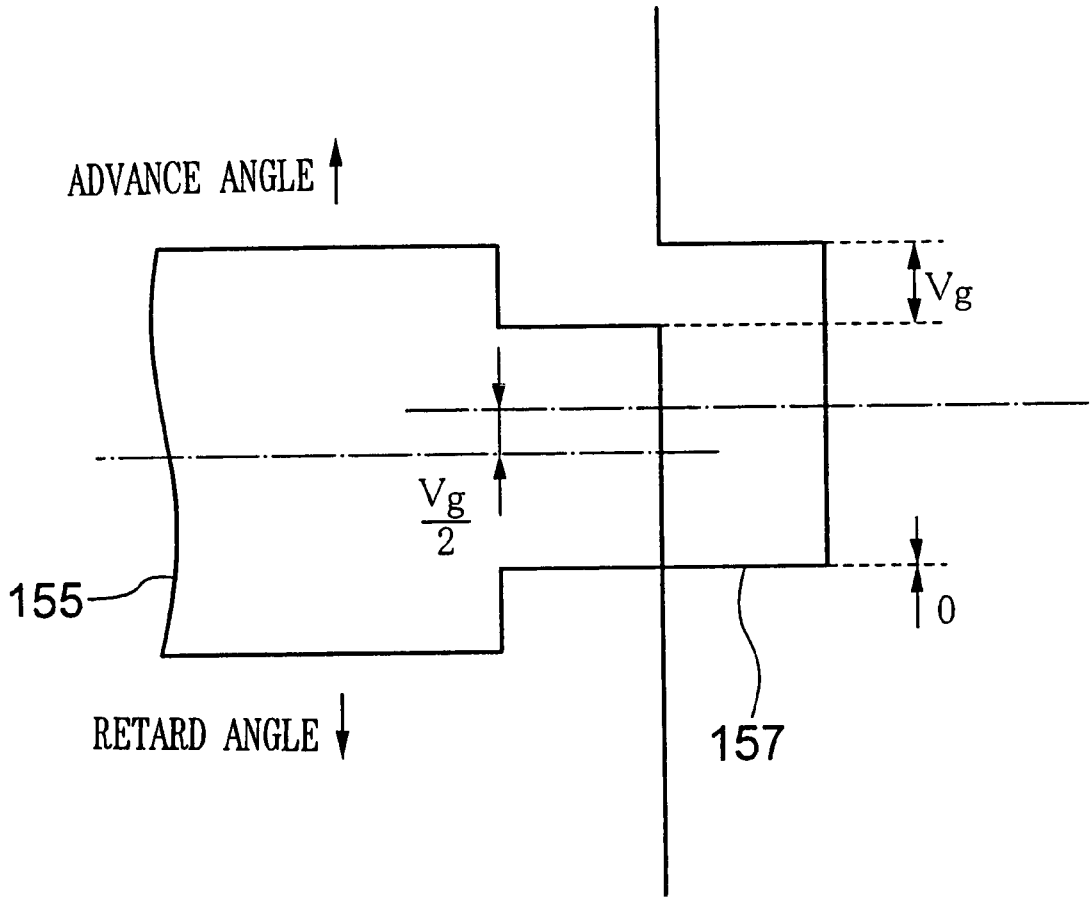
FIG. 7 is a diagram illustrating the case in which the target advance angle amount Vt is on the retard side with respect to the pin lock-up position Vr contrary to the case of FIG. 5.

FIGS. 6 and 7 show the case in which the target advance angle amount Vt is on the retard side with respect to the pin lock-up position Vr contrary to FIGS. 4 and 5. A point in time A of FIG. 6 is in the state in which the detected advance angle amount Vd approaches the pin lock-up position Vr most, and the positional relation between the lock pin 155 and the locking recess 157 is as shown in FIG. 7. The clearance on the retard side also becomes zero in this case, so that the lock pin 155 is engaged with the locking recess 157.

Thus, since the lock pin 155 is engaged with the locking recess 157 if the target advance angle amount Vt is set within a range of ±(Vc+Vg/2) from the pin lock-up position allowing for the steady variation and the amount of the clearance, the ECU 21A avoids setting the target advance angle amount Vt within this range. Therefore, the target advance angle amount is set further allowing for the amount of 1LSB α in addition to ±(Vc+Vg/2) in steps S204 and S1006 of FIG. 2.

Figure 8:
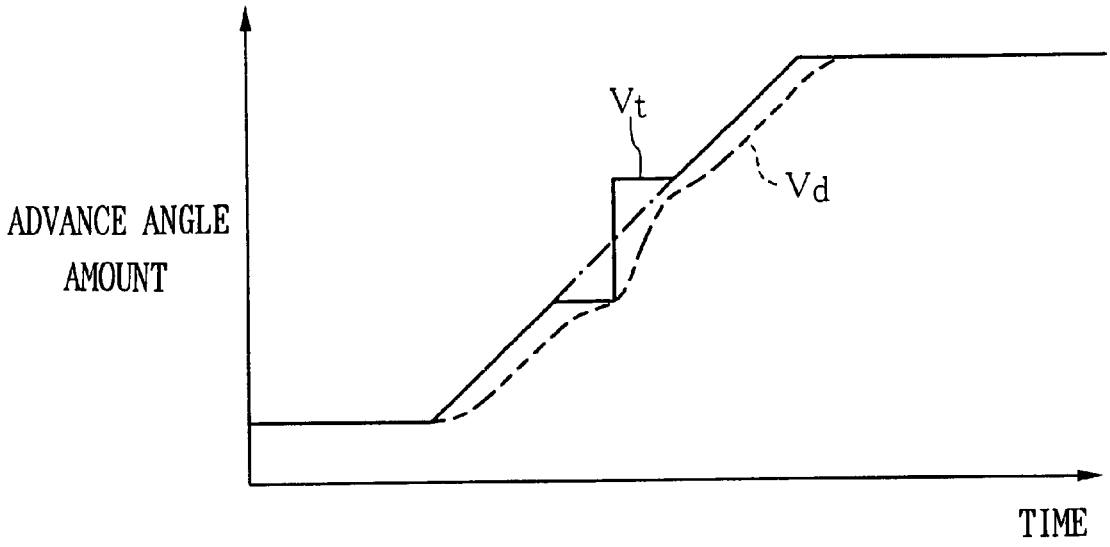
FIG. 8 is a diagram showing that the target advance angle amount Vt changes in a step-like manner in the vicinity of the pin lock-up position Vr.

In the state in which the target advance angle amount Vt changes in a ramp-like manner, the target advance angle amount Vt changes in a step-like manner in the vicinity of the pin lock-up position Vr as shown in FIG. 8. In this case, since the detected advance angle amount Vd is controlled by calculating a control amount from a deviation of the detected advance angle amount Vd and the target advance angle amount Vt, the control amount becomes large in accordance with the step-like change of the target advance amount. Therefore, the movement of the detected advance angle amount also becomes fast and the speed of the detected advance angle amount passing the pin lock-up position is fast. Thus, the lock pin 155 never hitches the locking recess 157, and the detected advance angle amount can follow the target advance angle amount.

Depending on an operating state of an engine, engine performance may be the best when a target advance angle amount is set to a pin lock-up position and controlled. In this case, change of the target advance angle amount by amounts of a steady variation and a pin clearance from the lock-up position results in decrease in the engine performance. However, the decrease in the engine performance can be smaller than the case in which the detected advance angle amount does not follow the target advance angle amount when the lock pin 155 hitches on the locking recess and the target advance angle amount changes or the pin lock is unlocked due to dispersion of an integrated value and the detected advance angle amount deviates largely from the target advance angle amount.

In this way, the ECU 21A does not control the target advance angle amount Vt in the range allowing for the steady variation Vc and the amount of the clearance Vg between the lock pin 155 and the locking recess 157 from the lock-up position, thereby preventing the situation in which the lock pin 155 hitches on the locking recess 157, the deviation between the target advance angle amount Vt and the detected advance angle amount Vd is not eliminated and the control output value Iout is dispersed by an integrated value although the control output value Iout is changed. In addition, when the lock pin 155 hitches on the locking recess 157 and the integrated value disperses largely, a passage to an actuator of an OCV is secured, the lock pin 155 is unlocked from the locking recess 157 and the detected advance angle amount deviates largely from the target advance angle amount, whereby deterioration of its driveability, mileage and gas exhausting performance is prevented.

Embodiment 2

Figure 9:
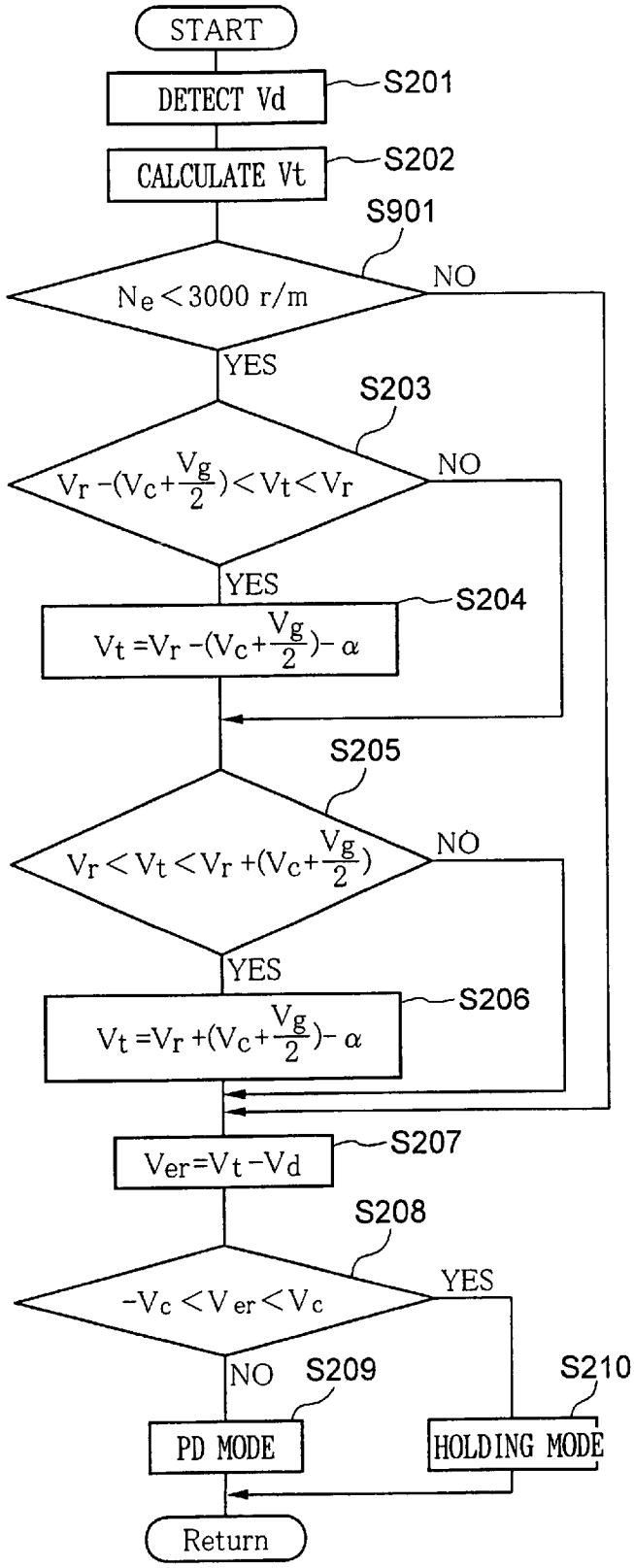
FIG. 9 is a flow chart showing control operations of the ECU 21A in accordance with a second embodiment of the present invention.

A second embodiment of the present invention will now be described. FIG. 9 is a flow chart showing control operations of the ECU 21A in accordance with the second embodiment of the present invention. In FIG. 9, steps identical with those in the first embodiment shown in FIG. 2 are given the identical reference numerals and their descriptions are omitted.

In this second embodiment, as shown in FIG. 9, it is determined in step S901 if a number of revolutions Ne of an engine is smaller than a predetermined number of revolutions (3000[r/m]) after the detection of the detected advance angle amount Vd and the calculation of the target advance angle amount Vt (steps S201 and S202) and only when the number of revolutions Ne is smaller, the ECU 21A moves to step S203 and performs calculation processing of the target advance angle amount Vt allowing for the steady variation Vc and the clearance Vg between the lock pin 155 and the locking recess 157. If the number of revolutions Ne is not smaller than the predetermined number of revolutions (3000 [r/m]), the ECU 21A moves to step S207. Other procedures are the same as those in the first embodiment.

In this way, since a hydraulic pressure is sufficiently secured and the lock pin 155 never hitches on the locking recess 157 when an engine speed is equal to or more than a predetermined number of revolutions, it does not cause any problem even if a target advance angle amount is set in the vicinity of a pin lock-up position to perform a positional control. Moreover, if engine performance is the best in a pin lock position, since the control in the pin lock-up position is possible, decrease in engine performance is also eliminated.

On the other hand, when an engine speed is equal to or less than a predetermined number of revolutions, the ECU 21A does not execute a control in the vicinity of a pin lock-up position to eliminate hitching of a pin as in the first embodiment. And then, the ECU 21A prevents a dispersion of a control value and a defect of a detected advance angle amount in following a target advance angle amount, whereby deterioration of its driveability, mileage and gas exhausting performance can be prevented.

Although it is described in the second embodiment that a target advance angle amount setting that allows for a steady variation and an amount of a pin clearance is not executed when an engine speed is equal to or more than a predetermined number of revolutions, unlocking of a lock pin is determined by a hydraulic pressure and the hydraulic pressure is substantially determined by a number of revolutions and a temperature factor. Thus, if it is intended to execute the target advance angle amount setting more precisely, the target advance angle amount may be corrected according to a water temperature that is a parameter of a warm-up state of an engine, or may be corrected by measuring an oil temperature. Alternatively, the target advance angle amount setting may be executed by directly measuring a hydraulic pressure.

Embodiment 3

Figure 10:
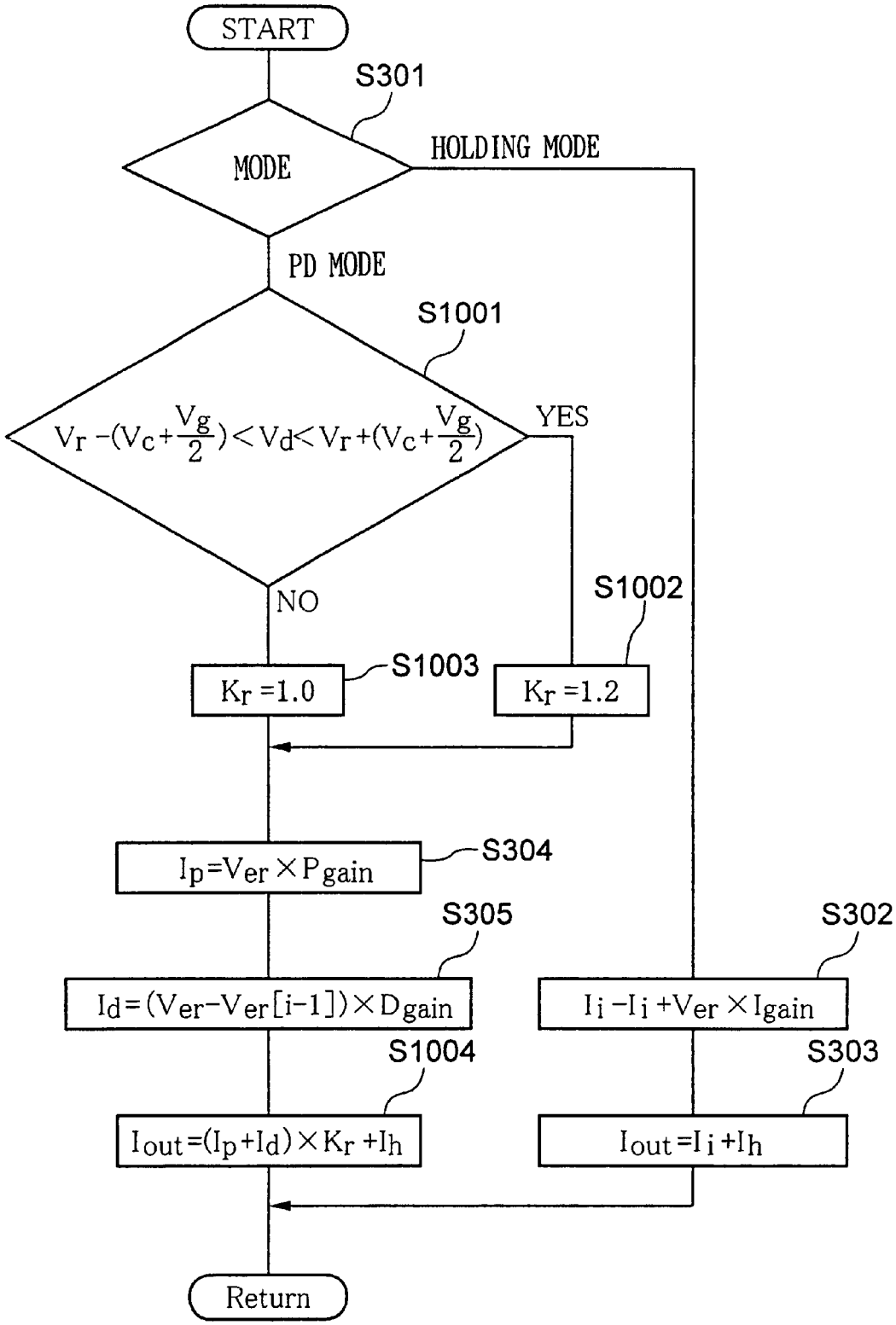
FIG. 10 is a flow chart showing control operations of the ECU 21A in accordance with a third embodiment of the present invention.

A third embodiment of the present invention will now be described. FIG. 10 is a flow chart showing control operations of the ECU 21A in accordance with the third embodiment of the present invention and corresponds to control procedures according to the mode in the first embodiment shown in FIG. 3. And control procedures in FIG. 10 at the time of the PD mode are different from those in FIG. 3. Further, in FIG. 10, steps identical with those in the first embodiment shown in FIG. 3 are given the identical reference numerals and their descriptions are omitted.

In this third embodiment, as shown in FIG. 10, if it is determined that the detected advance angle amount Vd is within a range allowing for a steady variation and an amount of a clearance from a pin lock-up position (Vr−(Vc+Vg/2) <Vd<Vr+(Vc+Vg/2)) in step S1001 after it is determined that the valve timing control is in the PD mode in step S301, the ECU 21A sets a correction coefficient Kr to a predetermined value larger than 1.0 (1.2) in step S1002. If it is determined that the detected advance angle amount Vd is not within the range in step S1001, the ECU 21A sets the correction coefficient Kr to 1.0 in step S1003. Then, the ECU 21A multiplies a sum of the proportional value Ip and the differentiated value Id by the correction coefficient Kr and adds the holding current learnt value Ih to the product to find the control output value Iout.

In this way, if a detected angle amount is within a range allowing for a steady variation and a clearance, since a target advance angle amount is corrected such that the control output value Iout increases, an acting speed increases and the lock pin 155 passes the locking recess 157 fast. Thus, the lock pin 155 never engages with the locking recess 157 and a defect of a detected advance angle amount in following a target advance angle amount due to hitching of a pin can be prevented, whereby deterioration of its driveability, mileage and gas exhausting performance can be prevented.

Embodiment 4

Figure 11:
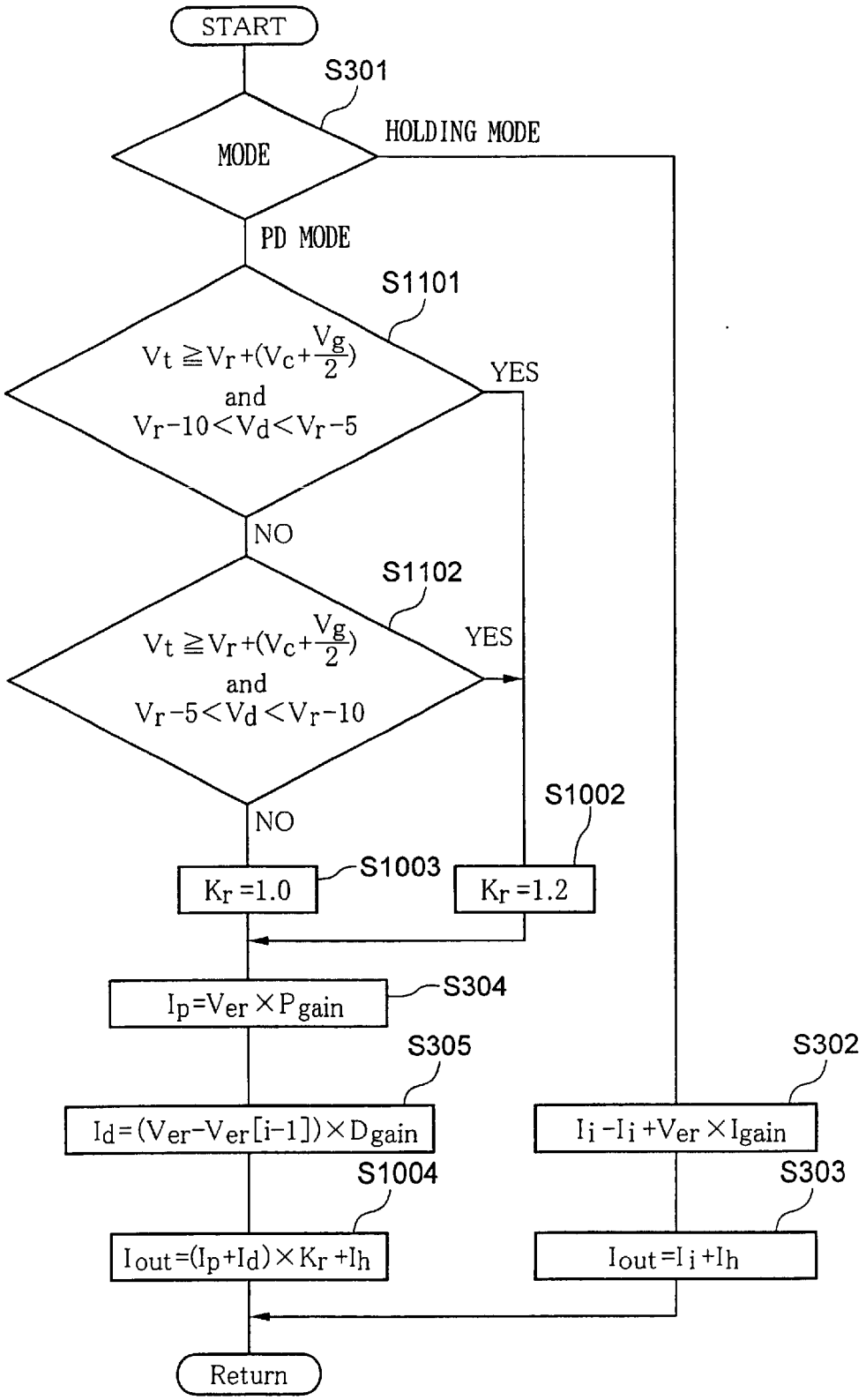
FIG. 11 is a flow chart showing control operations of the ECU 21A in accordance with a fourth embodiment of the present invention.

A fourth embodiment of the present invention will now be described. FIG. 11 is a flow chart showing control operations of the ECU 21A in accordance with the fourth embodiment of the present invention and corresponds to control procedures according to the mode in the first embodiment shown in FIG. 3. And control procedures in FIG. 11 at the time of the PD mode are different from those in FIG. 3. Further, in FIG. 11, steps identical with those in the first embodiment shown in FIG. 3 and those in the third embodiment shown in FIG. 10 are given the identical reference numerals and their descriptions are omitted.

In this fourth embodiment, as shown in FIG. 11, if it is determined that the target advance angle amount Vt is equal to or more than a position allowing for a steady variation and an amount of a clearance from a lock-up position (Vr+(Vc+Vg/2) and the detected advance angle amount Vd is within a range smaller than the lock-up position by a predetermined value (Vr−10<Vd<Vr−5) in step S1101 after it is determined that the valve timing control is in the PD mode in step S301, the ECU 21A sets the correction coefficient Kr to predetermined value larger than 1.0 (1.2) in step S1002 as in the third embodiment shown in FIG. 10.

On the other hand, if it is determined to the contrary in step S1101, the ECU 21 determines in step S1102 if the target advance angle amount Vt is equal to or less than a position allowing for a steady variation and an amount of a clearance from a lock-up position (Vr−(Vc+Vg/2) and the detected advance angle amount Vd is within a range larger than the lock-up position by a predetermined value (Vr+5<Vd<Vr+10). If it is determined affirmative in step S1102, the ECU 21A sets the correction coefficient Kr to a predetermined value larger than 1.0 (1.2) in step S1002. If it is determined negative is step S1102, the ECU 21 A sets the correction coefficient Kr to 1.0 in step S1303 as in the third embodiment shown in FIG. 10. Then, the ECU 21A multiplies a sum of the proportional value Ip and the differentiated value Id by the correction coefficient Kr in step S1004 and adds the holding current learnt value Ih to the product to find the control output value Iout.

In this way, if there is a delay from the time when the control output value Iout is changed until the time when a detected advance angle amount changes, since the ECU 21A corrects the control output value Iout such that an acting speed increases before the detected advance angle amount comes to the vicinity of a pin lock-up position, action of the detected advance angle amount in the pin lock-up position gets fast. Thus, since the lock pin 155 passes the locking recess 157 quickly, the pin never hitches on the locking recess, whereby deterioration of its driveability, mileage and gas exhausting performance can be prevented.

As described above, according to the present invention, since steady control of a valve timing in a position is not executed where a lock pin engages with a locking recess, the lock pin is prevented from being engaged with the locking recess and a defect of a detected advance angle amount in following a target advance angle amount, which is set optimally for engine performance, due to hitching of the lock pin can be prevented, whereby its driveability, mileage and gas exhausting performance can be prevented.

In addition, since a control value is corrected to a side on which an acting speed increases if a detected advance angle amount passes a pin lock-up position, a lock pin is prevented from engaging with a locking recess and a defect of a detected advance angle amount in following a target advance angle amount, which is set optimally for engine performance, due to hitching of the lock pin can be prevented, whereby its driveability, mileage and gas exhausting performance can be prevented.

What is claimed is:

1. A valve timing control system for an internal combustion engine, comprising:

sensor means for detecting engine operation states of an internal combustion engine;

intake or exhaust cam shafts for driving intake or exhaust valves, respectively, of said internal combustion engine in synchronism with a rotation of a crank shaft of said internal combustion engine;

at least one actuator operatively connected to at least one of cam shafts for driving said intake or exhaust valves, respectively;

a hydraulic pressure supply unit for feeding a hydraulic pressure to drive said actuator; and control means for controlling the hydraulic pressure fed from said hydraulic pressure supply unit to said actuator in dependence on said operating states of said internal combustion engine while changing a relative phase of said cam shaft relative to said crank shaft, wherein said actuator includes a retarding hydraulic chamber and an advancing hydraulic chamber for setting an adjustable range of said relative phase;

a locking mechanism for setting said relative phase to a lock-up position within said adjustable range; and an unlocking mechanism for releasing said locking mechanism in response to a predetermined level of hydraulic pressure fed from said hydraulic pressure supply unit, and said control means restricts control of a valve timing within a predetermined range of a lock-up position in said locking mechanism, wherein restraining said control means not executing steady control, and wherein said control means detects a detected advance angle amount that is a phase difference between phases of said crank shaft and said cam shaft and calculates a target advance angle amount that is valve timing suitable for an operating state of said internal combustion engine not to set said target advance angle amount in a predetermined range of said lock-up position of said locking mechanism in the case in which said control means controls such that said detected advance angle amount substantially coincides with said target advance angle amount.

2. A valve timing control system for an internal combustion engine according to claim 1, wherein said predetermined range is at least a variation range of steady control or the variation range of the steady control and an amount of a clearance by said locking mechanism.

3. A valve timing control system for an internal combustion engine according to claim 1, wherein said steady control is not executed only when the operating state of said internal combustion engine is in a predetermined state.

4. A valve timing control system for an internal combustion engine according to claim 1, wherein said control means corrects a control amount with respect to a normal time if a detected advance angle amount is within a range allowing for a steady variation and an amount of a clearance from said lock-up position.

5. A valve timing control system for an internal combustion engine according to claim 4, wherein the correction of said control amount is performed such that an acting speed increases.

6. A valve timing control system for an internal combustion engine according to claim 4, wherein, if there is a delay from the time when said control amount is changed until the time when a detected advance angle amount changes, said control means corrects said control amount earlier by a time corresponding to the delay.

* * * * *